US010696368B2

(12) United States Patent
Mizutani et al.

(10) Patent No.: US 10,696,368 B2
(45) Date of Patent: Jun. 30, 2020

(54) OUTBOARD MOTOR

(71) Applicants: YAMAHA HATSUDOKI KABUSHIKI KAISHA, Iwata-shi, Shizuoka (JP); MARINE CANADA ACQUISITION INC., Richmond (CA)

(72) Inventors: Makoto Mizutani, Shizuoka (JP); Morihiko Nanjo, Shizuoka (JP); Noam Dean Davidson, Richmond (CA); Ray Tat Lung Wong, Richmond (CA)

(73) Assignees: YAMAHA HATSUDOKI KABUSHIKI KAISHA, Shizuoka (JP); MARINE CANADA ACQUISITION INC., Richmond (CA)

( * ) Notice: Subject to any disclaimer, the term of this patent is extended or adjusted under 35 U.S.C. 154(b) by 0 days.

(21) Appl. No.: 16/409,940

(22) Filed: May 13, 2019

(65) Prior Publication Data

US 2019/0344870 A1 Nov. 14, 2019

(30) Foreign Application Priority Data

May 14, 2018 (JP) ..... 2018-092955

(51) Int. Cl.
*B63H 20/12* (2006.01)
*B63H 20/10* (2006.01)
*B63H 25/02* (2006.01)

(52) U.S. Cl.
CPC ..... *B63H 20/12* (2013.01); *B63H 20/10* (2013.01); *B63H 25/02* (2013.01)

(58) Field of Classification Search
CPC ..... B63H 20/00; B63H 20/06; B63H 20/10; B63H 20/12; B63H 25/00; B63H 25/02; B63H 5/125
USPC ..... 440/53, 59, 61 S, 63
See application file for complete search history.

(56) References Cited

U.S. PATENT DOCUMENTS

| | | | | |
|---|---|---|---|---|
| 7,311,571 | B1 | 12/2007 | Swan et al. | |
| 7,527,537 | B2 * | 5/2009 | Mizutani | B63H 20/12 440/63 |
| 2007/0105463 | A1 | 5/2007 | Mizutani | |
| 2012/0045951 | A1 * | 2/2012 | Washino | B63H 20/12 440/63 |
| 2012/0094557 | A1 | 4/2012 | Takase | |
| 2016/0201776 | A1 | 7/2016 | Takase | |

FOREIGN PATENT DOCUMENTS

| | | |
|---|---|---|
| JP | 2005-193739 A | 7/2005 |
| JP | 2006-264522 A | 10/2006 |

* cited by examiner

*Primary Examiner* — Lars A Olson
(74) *Attorney, Agent, or Firm* — Keating and Bennett, LLP

(57) ABSTRACT

An inner circumferential surface of a clamp bracket is open at an inner side surface of the clamp bracket. At least a portion of a movable body is surrounded by the inner circumferential surface in a side view. The movable body is movable to a plurality of positions including a position above a swivel bracket and a position inside a space surrounded by the inner circumferential surface of the clamp bracket. A steering shaft rotates around a steering axis along with movement of the movable body.

15 Claims, 12 Drawing Sheets

OUTBOARD MOTOR

CROSS REFERENCE TO RELATED APPLICATIONS

This application claims the benefit of priority to Japanese Patent Application No. 2018-092955 filed on May 14, 2018. The entire contents of this application are hereby incorporated herein by reference.

BACKGROUND OF THE INVENTION

1. Field of the Invention

The present invention relates to an outboard motor that propels a vessel.

2. Description of the Related Art

U.S. Pat. No. 7,311,571 B1 discloses a marine propulsion system including an outboard motor. The marine propulsion system includes a transom bracket to be attached to a transom, a swivel bracket supported by the transom bracket rotatably around a tilt axis, and a steering cylinder that rotates the outboard motor around a steering axis.

The steering cylinder is disposed at a position above the transom bracket and below a cowl of the outboard motor in a side view. The steering cylinder is integral and unitary with the swivel bracket. The steering cylinder houses a piston member. When the piston member moves along a centerline of the steering cylinder inside the steering cylinder, a swivel tube is driven around the steering axis.

In a conventional marine propulsion system, a hydraulic cylinder for steering is disposed in front of the swivel bracket. When the outboard motor is tilted up, the hydraulic cylinder moves to the front side of the transom, so that a space within which the hydraulic cylinder is disposed must be secured inside a vessel. In the marine propulsion system disclosed in U.S. Pat. No. 7,311,571 B1, to avoid this, the steering cylinder is disposed above the transom bracket.

However, in the marine propulsion system disclosed in U.S. Pat. No. 7,311,571 B1, a space within which the steering cylinder is disposed must be secured between the transom bracket and the cowl of the outboard motor, so that the cowl needs to be downsized or the entire outboard motor needs to be moved upward. If the cowl is downsized, the layout of devices such as an internal combustion to be disposed inside the cowl is further limited. If the entire outboard motor is moved upward, a portion of the outboard motor which enters the inside of the hull when the outboard motor is tilted up becomes larger. Therefore, a larger space needs to be secured inside the hull.

SUMMARY OF THE INVENTION

In order to overcome the previously unrecognized and unsolved challenges described above, preferred embodiments of the present invention provide outboard motors that are able to provide and position rearward movable bodies that steer outboard motor main bodies without influencing sizes of cowls and positions of the outboard motor main bodies. A preferred embodiment of the present invention provides an outboard motor including a pair of clamp brackets each provided with an inner side surface, an inner circumferential surface that is open at the inner side surface, and an attaching portion attachable to a rear surface of a hull, and spaced apart from each other in the right-left direction;

a swivel bracket disposed between the pair of clamp brackets, and rotatable with respect to the pair of clamp brackets around a tilt axis extending in the right-left direction; a movable body at least a portion of which is surrounded by the inner circumferential surface of the clamp bracket in a side view of the outboard motor and movable to a plurality of positions including a position above the swivel bracket and a position inside a space surrounded by the inner circumferential surface of the clamp bracket; a steering shaft that rotates around a steering axis extending in the up-down direction in accordance with movement of the movable body; and an outboard motor main body that rotates around the steering axis together with the steering shaft and includes a prime mover that generates power to rotate a propeller.

With the above structural arrangement, the outboard motor main body, which rotates a propeller, rotates around the steering axis together with the steering shaft in accordance with movement of the movable body. At least a portion of the movable body is surrounded by the inner circumferential surface of the clamp bracket in a side view. Therefore, a space within which the movable body is disposed does not need to be provided between the clamp brackets and the cowl. Further, the movable body is movable to the inside of the inner circumferential surface of the clamp bracket, so that the clamp brackets do not need to be disposed laterally of a moving range of the movable body. Therefore, the pair of clamp brackets are prevented from increasing in size in the right-left direction.

When the outboard motor main body rotates in the right-left direction around the steering axis, the outboard motor main body approaches the right or left clamp bracket. If the width between the pair of clamp brackets in the right-left direction is large, the outboard motor main body may come into contact with the clamp bracket. Therefore, in order to prevent this, the clamp brackets need to be shortened in the front-rear direction or reduced in size in the right-left direction. With the above-described structural arrangement, the width between the pair of clamp brackets is reduced, so that the above measures are unnecessary.

According to a preferred embodiment of the present invention, the movable body may overlap the tilt axis in a side view of the outboard motor.

When the outboard motor main body rotates around the tilt axis, the movable body also rotates around the tilt axis. When the movable body overlaps the tilt axis in a side view, the range through which the movable body passes is smaller than in the case in which the movable body does not overlap the tilt axis. Therefore, a space inside a vessel in which a portion of the outboard motor main body is disposed when the outboard motor main body is tilted up is reduced. Accordingly, the space inside the vessel is effectively utilized.

According to a preferred embodiment of the present invention, the outboard motor may further include a support shaft extending in an axial direction parallel to or substantially parallel to the tilt axis. The movable body may be movable in an axial direction of the support shaft along the support shaft along the support shaft.

According to a preferred embodiment of the present invention, the support shaft may penetrate through the clamp bracket.

The movable body moves in the axial direction of the support shaft along the support shaft. If the support shaft is long, the moving range of the movable body is enlarged. If the moving range of the movable body is large, a steering angle of the outboard motor main body (rotation angle around the steering axis) is increased. With the above structural arrangement, the support shaft is elongated so as to penetrate through the clamp bracket. Therefore, the moving range of the movable body is enlarged, and the steering angle of the outboard motor main body is increased.

According to a preferred embodiment of the present invention, the outboard motor may further include a shaft damper that supports the support shaft.

With the above structural arrangement, an impact applied to the support shaft is absorbed by the shaft damper. Therefore, the strength required for the support shaft is reduced, so that the support shaft is able to be reduced in size. Further, an impact applied to the movable body via the support shaft is also absorbed, so that the movable body is able to be reduced in size. Thus, since the movable body and the support shaft are downsized, the width between the pair of clamp brackets is further reduced.

According to a preferred embodiment of the present invention, the swivel bracket may include a tubular portion surrounding the tilt axis and is inserted in the inner circumferential surface of the clamp bracket. The movable body may be movable to a position inside a space surrounded by both of the inner circumferential surface of the clamp bracket and the tubular portion.

With the above structural arrangement, the tubular portion corresponding to a tilting shaft is provided on the swivel bracket. The swivel bracket is rotatable around the tubular portion with respect to the clamp brackets. The movable body is movable to the inside of the tubular portion. In other words, the tilting shaft to be inserted in the clamp bracket defines a space inside which the movable body is disposed inside the clamp bracket. Accordingly, the width between the pair of clamp brackets is reduced while the moving range of the movable body is maintained.

According to a preferred embodiment of the present invention, the outboard motor may further include a motion converter including a driven member that rotates around the steering axis together with the steering shaft and a drive member disposed closer to the driven member than the movable body and moves in a movement direction of the movable body together with the movable body, and that converts movement of the movable body into rotation of the steering shaft.

With the above structural arrangement, when the movable body and the drive member move in a movement direction of the movable body, the driven member pivots around the steering axis. When the pivoting angle of the driven member (rotation angle around the steering axis) is the same, the larger the distance from the steering axis to the tip end of the driven member, the larger the pivoting range of the driven member (range through which the driven member passes). If the pivoting range of the driven member is large, the width between the pair of clamp brackets may have to be increased.

For example, if the movable body is located closer to the driven member, the distance to the tip end of the driven member is shortened. However, if the movable body is located closer to the driven member, the cowl may need to be downsized or the outboard motor main body may need to be moved upward.

With the above structural arrangement, a portion of the drive member is positioned between the movable body and the driven member. Therefore, without locating the movable body closer to the driven member, the movement of the movable body is transmitted to the driven member. Accordingly, the pivoting range of the driven member is reduced without changing the size of the cowl and the position of the outboard motor main body. Therefore, the width between the pair of clamp brackets is narrowed.

According to a preferred embodiment of the present invention, the drive member may be shorter in the up-down direction than the movable body, and may be shorter in the right-left direction than the movable body.

A portion of the drive member is positioned between the movable body and the driven member. If the driven member is long in the up-down direction, the size of the cowl or the position of the outboard motor main body may need to be changed. However, the drive member is shorter in the up-down direction than the movable body, so that without changing the size of the cowl and the position of the outboard motor main body, a portion of the drive member is disposed between the movable body and the driven member. Further, since the drive member is shorter in the right-left direction than the movable body, although the moving distance of the drive member in the movement direction is the same as that of the movable body, the movement range of the drive member (range through which the drive member passes) is smaller than that of the movable body. Therefore, the width between the pair of clamp brackets is further narrowed.

According to a preferred embodiment of the present invention, the motion converter may further include a guide that guides the drive member in the movement direction of the movable body.

With the above structural arrangement, since the drive member is guided by the guide, the drive member is moved in a stable manner in the movement direction. Further, the drive member is supported by both of the movable body and the guide, so that warping of the drive member is significantly reduced or prevented.

According to a preferred embodiment of the present invention, the motion converter may further include a guide damper that supports the guide.

With the above structural arrangement, an impact applied to the guide is absorbed by the guide damper. Therefore, since the strength required for the guide is reduced, the guide is able to be reduced in size. Thus, the guide is downsized, so that the width between the pair of clamp brackets is further reduced.

According to a preferred embodiment of the present invention, the motion converter may further include a rotation arm that is rotatable around a rotation axis parallel to or substantially parallel to the steering axis, and transmits motion, transmitted from the drive member, to the driven member.

With the above structural arrangement, motion of the drive member is converted into rotation of the rotation arm, and the rotation of the rotation arm is converted into rotation of the driven member. Accordingly, the steering shaft rotates around the steering axis. By providing the rotation arm, the tip end of the drive member is spaced apart from the driven member as compared with the case in which the rotation arm is not provided. Accordingly, a projection amount of the drive member from the movable body is reduced, and a bending moment to be applied to the drive member is reduced. Further, the drive member is shortened, so that the guide that supports the drive member may be omitted.

According to a preferred embodiment of the present invention, the outboard motor may further include a support shaft extending in an axial direction parallel to or substantially parallel to the tilt axis, and a fixing nut that is attached to the support shaft and prevents a rotation of the support shaft with respect to the swivel bracket. The movable body may include an inner tube that surrounds the support shaft, an electric motor that rotates the inner tube, and at least one reduction gear that moves the inner tube and the support shaft relatively in the axial direction of the support shaft in accordance with either a rotation of the inner tube or a rotation of the support shaft.

With the above structural arrangement, the support shaft is prevented from rotating with respect to the swivel bracket by the fixing nut attached to the support shaft. When the electric motor rotates the inner tube, the rotation of the inner tube is converted into the relative motion of the inner tube and the support shaft in the axial direction of the support shaft by the at least one reduction gear. Thus, the movable body moves in the right-left direction and the outboard motor main body is steered automatically.

When the fixing nut is loosened, the rotation of the support shaft with respect to the swivel bracket is no longer prevented. In this state, when an operator rotates the support shaft, the rotation of the support shaft is converted into the relative motion of the inner tube and the support shaft in the axial direction of the support shaft by the at least one reduction gear. Thus, the movable body moves in the right-left direction and the outboard motor main body is steered manually.

It is conceivable that the operator directly pushes the outboard motor main body so as to manually steer the outboard motor main body. In this case, if the reduction ratio of the at least one reduction gear is large, even when a circuit to drive the electric motor is opened, the outboard motor main body is not steered manually unless a large force is applied to the outboard motor main body. In contrast, in a case of rotating the support shaft, the outboard motor main body is steered manually with a small force as compared with a case in which the outboard motor main body is pushed directly.

According to a preferred embodiment of the present invention, the outboard motor may further include a handle, which is to be handled by an operator to rotate the support shaft. The support shaft includes a handle attachment to which the handle is attached. The operator may be a user or a dealer of the outboard motor, or may be a person in charge of the maintenance of the outboard motor.

With the above structural arrangement, the handle, which is to be operated when the outboard motor main body is steered manually, is provided in the outboard motor and attached to the handle attachment. Thus, the user of the outboard motor does not need to prepare a tool, etc., and to attach the tool, etc., to the handle attachment. The time required to prepare the manual steering of the outboard motor main body is shortened accordingly.

According to a preferred embodiment of the present invention, the support shaft may be prevented from rotating with respect to the swivel bracket only by the fixing nut.

With the above structural arrangement, the support shaft is prevented from rotating with respect to the swivel bracket only by the single fixing nut. In a case in which a plurality of fixing nuts are attached to the support shaft, the prevention of the rotation of the support shaft with respect to the swivel bracket is not released unless all of the fixing nuts are loosened. In contrast, in a case in which the support shaft is prevented from rotating with respect to the swivel bracket only by the single fixing nut, the prevention of the rotation of the support shaft with respect to the swivel bracket is released only by loosening the single fixing nut. Thus, the time required to prepare the manual steering of the outboard motor main body is shortened.

According to a preferred embodiment of the present invention, the support shaft may be prevented from rotating with respect to the clamp bracket.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

As described below, the outboard motor main body 2 is turnable rightward or leftward around a steering axis As, and is turnable upward or downward around a tilt axis At. The outboard motor main body 2 in a reference posture will be hereinafter described unless specific notice is given. The reference posture is a posture in which a rotation axis Ac of a crankshaft 12 extends in the vertical direction and a rotation axis Ap of a propeller shaft 15 that is perpendicular or substantially perpendicular to the rotation axis Ac of the crankshaft 12 extends in a front-rear direction. The front-rear direction, an up-down direction, and a right-left direction are defined based on the outboard motor main body 2 in the reference posture. A width direction corresponds to the right-left direction. "Lateral" and "laterally" mean "outward in the width direction."

Figure 1:
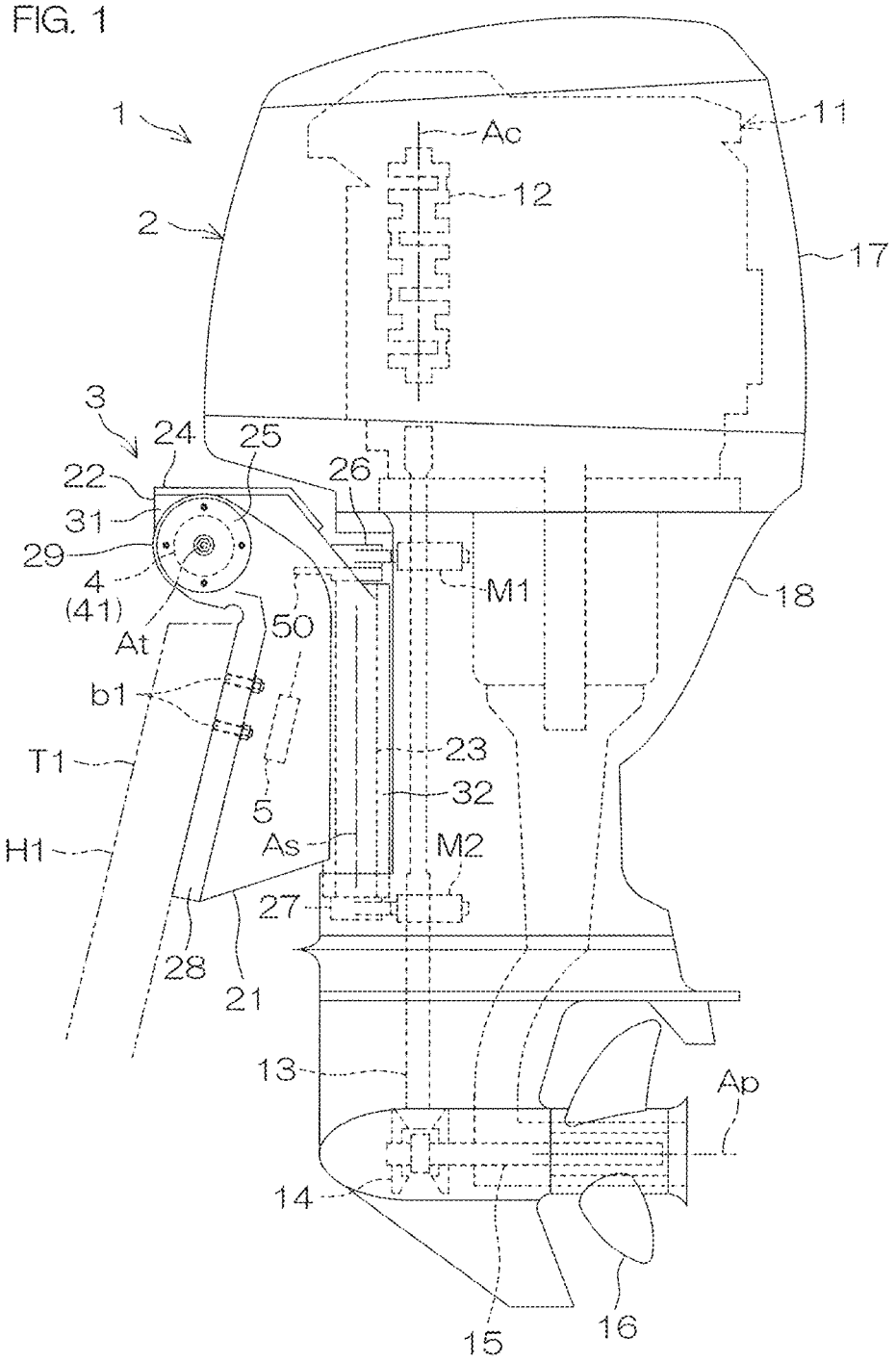
FIG. 1 is a schematic view showing a left side of an outboard motor according to a first preferred embodiment of the present invention.
Figure 2:
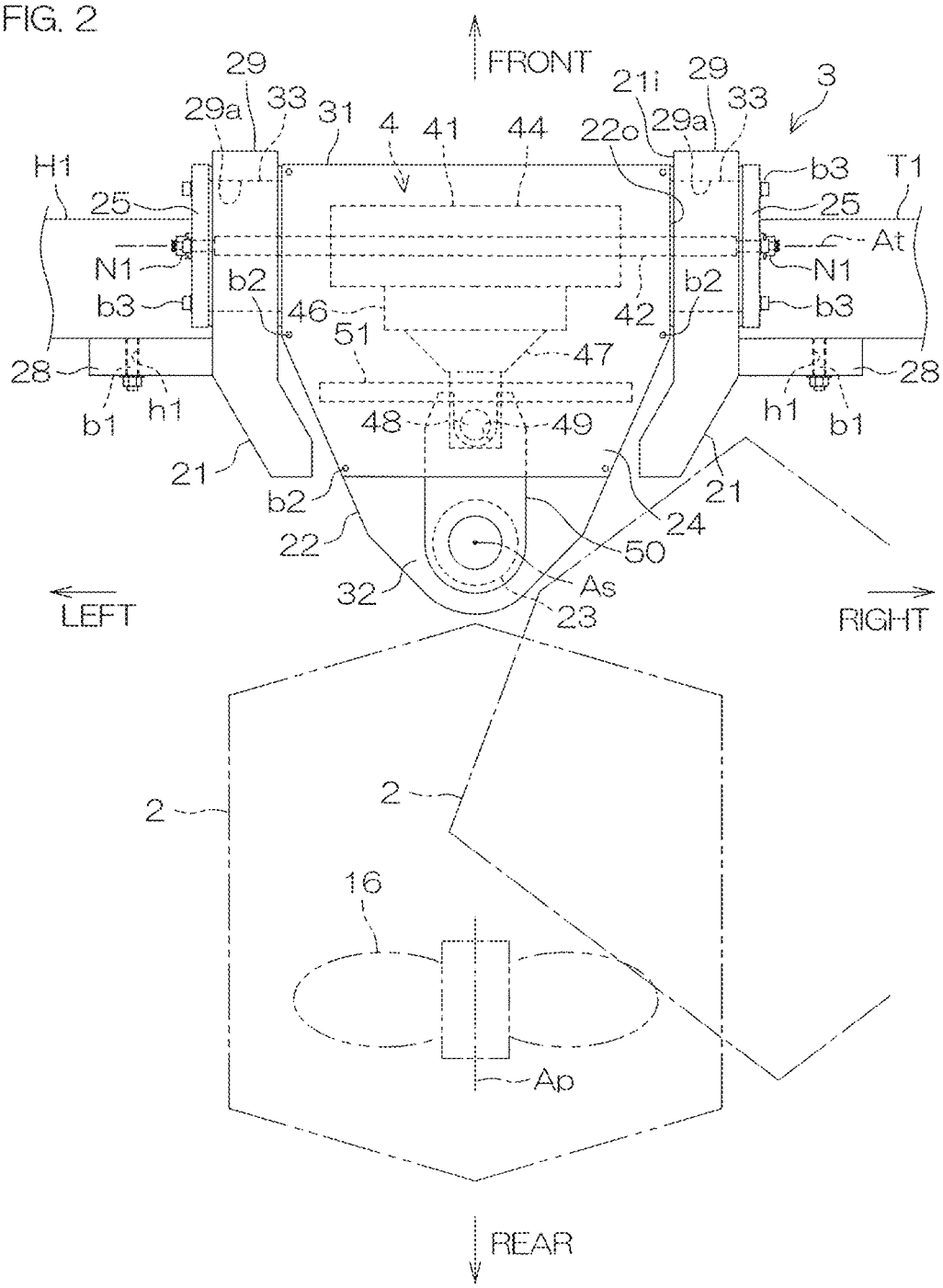
FIG. 2 is a schematic view showing a suspension device included in the outboard motor, viewed from above.

FIG. 1 is a schematic view showing a left side of an outboard motor 1 according to a first preferred embodiment of the present invention. FIG. 2 is a schematic view showing a suspension device 3 included in the outboard motor 1, viewed from above. In FIG. 2, a contour of an outer surface of the outboard motor main body 2 at a height equal to a height of an upper end of a transom T1 is shown by an alternate long and two short dashed line and an alternate long and short dashed line. The alternate long and two short dashed line shows a state in which an outboard motor main body 2 is positioned at an original position between a right maximum steered position and a left maximum steered position. The alternate long and short dashed line shows a state in which the outboard motor main body 2 is positioned at the right maximum steered position.

As shown in FIG. 1, the outboard motor 1 includes the outboard motor main body 2 that generates thrust to propel a vessel, a suspension device 3 to mount the outboard motor main body 2 to a hull H1, a steering device 4 that turns the outboard motor main body 2 in the right-left direction, and a tilting device 5 that turns the outboard motor main body 2 around the tilt axis At extending horizontally in the right-left direction.

The outboard motor main body 2 includes an engine 11 as an example of a prime mover that generates power to rotate a propeller 16, and a power transmission device that transmits power of the engine 11 to the propeller 16. The outboard motor main body 2 further includes an engine cowl 17 housing the engine 11, and a casing 18 housing the power transmission device. Rotation of the crankshaft 12, which is rotatable around the rotation axis Ac extending in the up-down direction, is transmitted to the propeller 16 via a drive shaft 13, a forward-reverse switching mechanism 14, and the propeller shaft 15 of the power transmission device.

The suspension device 3 includes a pair of clamp brackets 21 attachable to a transom T1 provided on a rear portion of the hull H1, a swivel bracket 22 supported by the pair of clamp brackets 21 rotatably around the tilt axis At extending in the right-left direction, and a steering shaft 23 supported by the swivel bracket 22 rotatably around the steering axis As extending in the up-down direction.

The suspension device 3 further includes a top cover 24 disposed above the swivel bracket 22, a pair of end caps 25 respectively disposed on the right and left of the pair of clamp brackets 21, and an upper mount bracket 26 and a lower mount bracket 27 that join the steering shaft 23 to an upper damper mount M1 and a lower damper mount M2 disposed inside the outboard motor main body 2.

As shown in FIG. 2, the pair of clamp brackets 21 are respectively disposed on the right and left of the swivel bracket 22. An inner side surface 21*i* of the clamp bracket 21 faces an outer surface 22*o* of the swivel bracket 22. The clamp bracket 21 includes an attaching portion 28 to be attached to the hull H1, and a swivel support 29 that supports the swivel bracket 22. The attaching portion 28 is disposed at the rear of the transom T1. The swivel support 29 is disposed above the transom T1. A bolt b1 that fixes the clamp bracket 21 to the hull H1 is inserted in a bolt attaching hole h1 provided in the attaching portion 28.

The swivel bracket 22 includes a housing 31 that houses the steering device 4, a tubular shaft support 32 that supports the steering shaft 23 rotatably, and a pair of tubular portions 33 supported by the swivel supports 29 of the clamp brackets 21. The pair of tubular portions 33 are respectively disposed on the right and left of the housing 31. The tubular portions 33 project laterally from the housing 31. The tubular portions 33 extend in the right-left direction. The shaft support 32 is positioned more rearward than the tubular portions 33. The steering shaft 23 is inserted in the shaft support 32. The centerline of the steering shaft 23 is positioned on the steering axis As.

As shown in FIG. 1, the upper mount bracket 26 and the lower mount bracket 27 are respectively disposed above and below the shaft support 32. The upper mount bracket 26 is joined to the upper damper mount M1 by a bolt, for example, and the lower mount bracket 27 is joined to the lower damper mount M2 by a bolt, for example. The upper mount bracket 26 and the lower mount bracket 27 rotate around the steering axis As together with the steering shaft 23.

Figure 3:
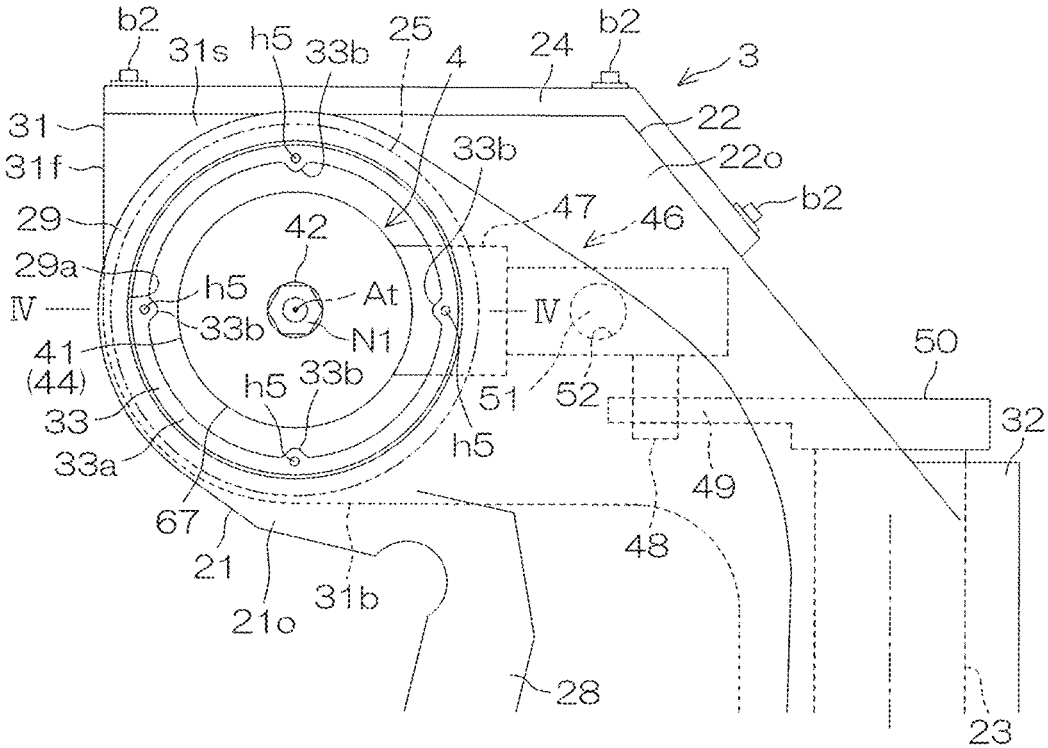
FIG. 3 is a schematic view of an upper portion of the suspension device, viewed from a left side.
Figure 4:
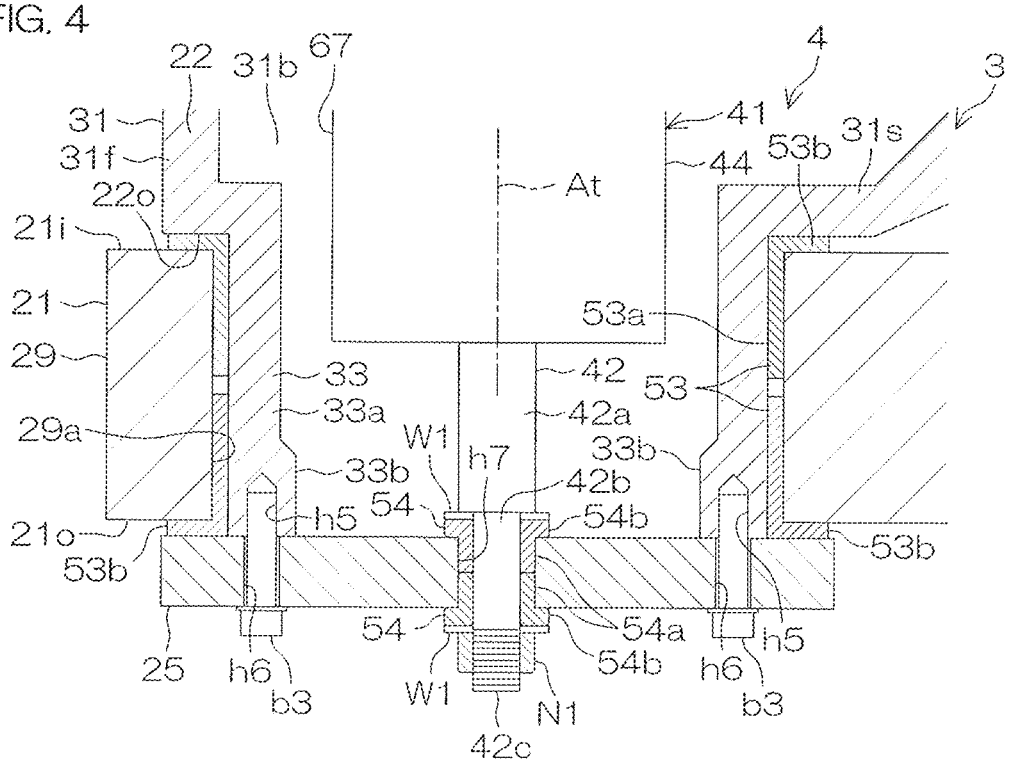
FIG. 4 is a sectional view showing a horizontal section taken along line IV-IV in FIG. 3.
Figure 5:
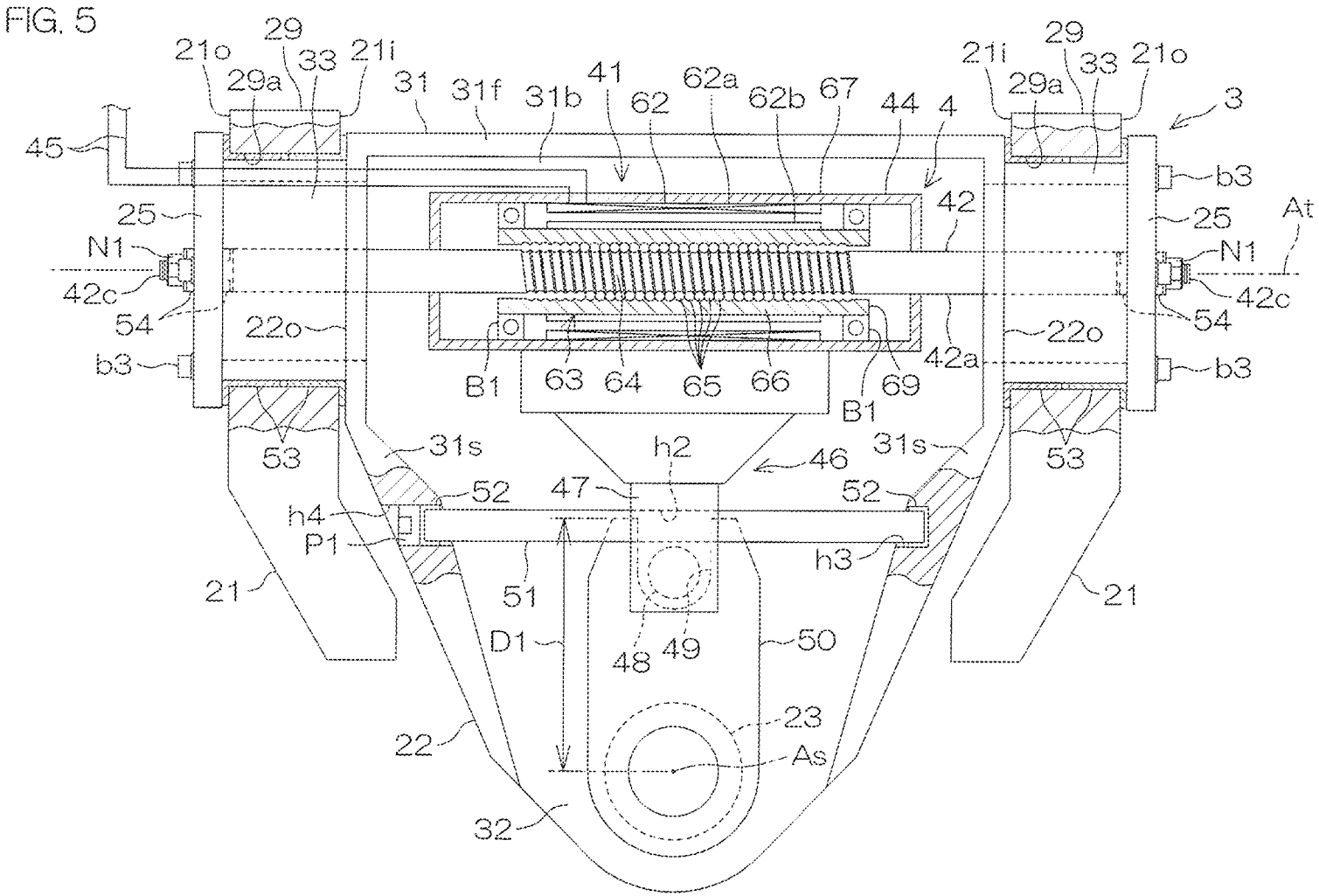
FIG. 5 is a partial sectional view of the suspension device from which a top cover has been removed, viewed from above, showing a state in which a steering tube is positioned at the center.
Figure 6:
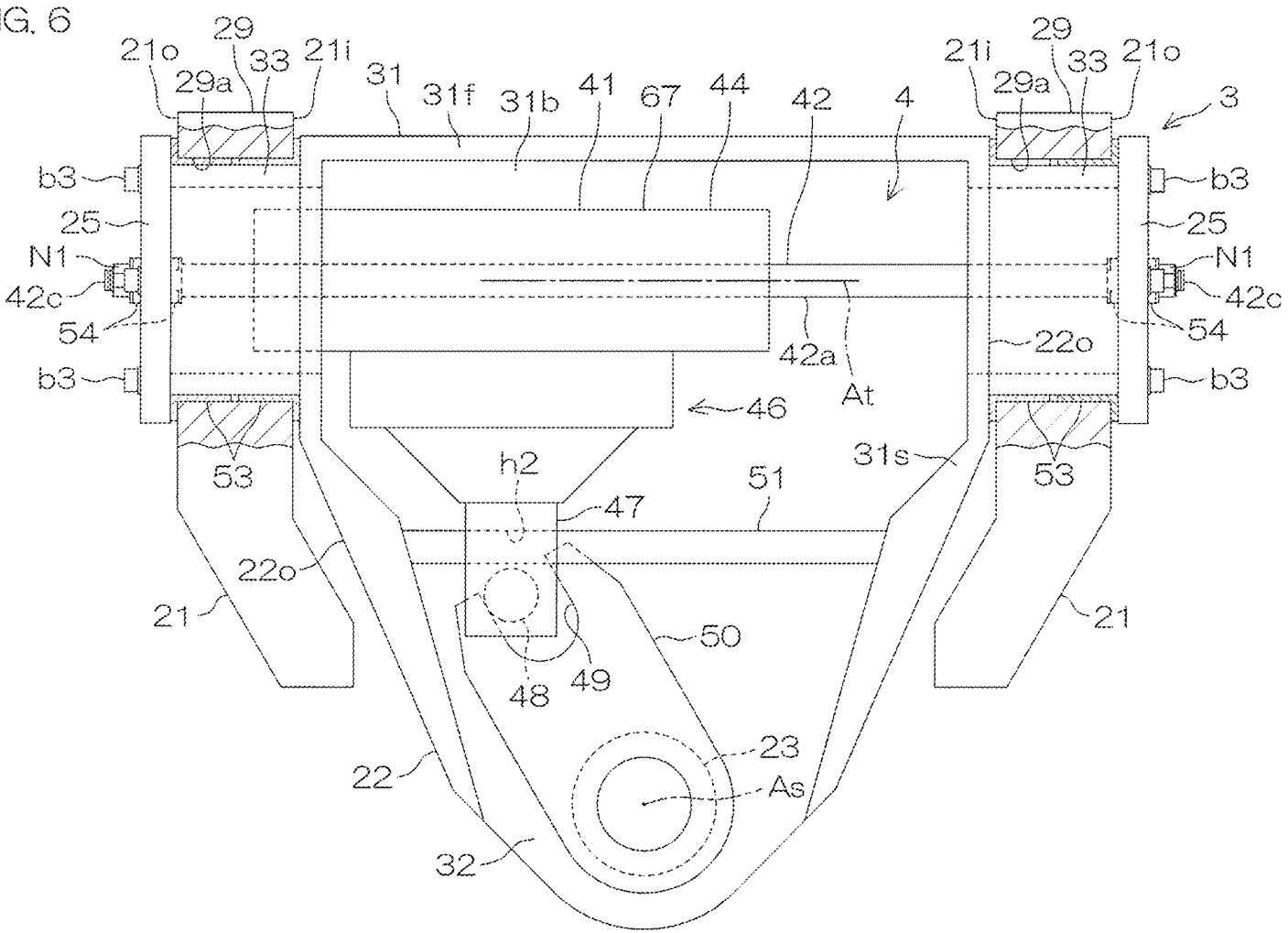
FIG. 6 is a partial sectional view of the suspension device from which the top cover has been removed, viewed from above, showing a state in which the steering tube has moved to the left.

FIG. 3 is a schematic view of an upper portion of the suspension device 3, viewed from a left side. FIG. 4 is a sectional view showing a horizontal section taken along line IV-IV in FIG. 3. FIG. 5 and FIG. 6 are partial sectional views of the suspension device 3 from which the top cover 24 has been removed, viewed from above. In FIG. 3, the end caps 25 and bushings 53, etc., are not shown. FIG. 5 shows a state in which a steering tube 44 is positioned at the center, and FIG. 6 shows a state in which the steering tube 44 has moved leftward.

As shown in FIG. 3, the housing 31 of the swivel bracket 22 includes a bottom wall 31*b* disposed between the pair of clamp brackets 21, a front wall 31*f* extending upward from a front edge of the bottom wall 31*b*, and two side walls 31*s* respectively extending upward from a right edge and a left edge of the bottom wall 31*b*. The top cover 24 is joined to the housing 31 by bolts b2, for example. The top cover 24 and the housing 31 define a housing chamber that houses the steering device 4. A steering actuator 41 of the steering device 4 is disposed at a position above the bottom wall 31*b* and behind the front wall 31*f*.

As shown in FIG. 4, the swivel support 29 of the clamp bracket 21 is positioned laterally of the housing 31 of the swivel bracket 22. A tubular portion 33 of the swivel bracket 22 is inserted in the swivel support 29. The tubular portion 33 is supported by the swivel support 29 via a plurality of bushings 53 disposed between the tubular portion 33 and the swivel support 29. The tubular portion 33 penetrates through the swivel support 29 in the right-left direction. The end cap 25 is fixed to the tubular portion 33 by a plurality of bolts b3, for example. A steering rod 42 of the steering actuator 41 provided in the steering device 4 is supported by two end caps 25 via a plurality of shaft dampers 54.

As shown in FIG. 5, the steering device 4 includes an electric steering actuator 41 that converts electric power into linear motion in the right-left direction and a motion converter 46 that converts the linear motion generated from the steering actuator 41 into rotation of the steering shaft 23. The steering actuator 41 includes the steering rod 42 that extends in the right-left direction and the steering tube 44 that reciprocates in the right-left direction along the steering rod 42. The steering rod 42 is an example of a support shaft.

The steering tube 44 and the steering rod 42 extend in the right-left direction along the tilt axis At. The steering rod 42 penetrates the steering tube 44 in the right-left direction. Both end portions of the steering rod 42 protrude from both end portions of the steering tube 44, respectively. The both end portions of the steering rod 42 are supported by the swivel bracket 22 via two end caps 25.

The steering tube 44 includes an inner tube 69 that surrounds the steering rod 42 and an electric motor 62 that rotates the inner tube 69. The steering tube 44 further includes reduction gears 63 that move the inner tube 69 and the steering rod 42 relatively in an axial direction of the steering rod 42 in accordance with the rotation of the inner tube 69 or the steering rod 42 and a tubular housing 67 that houses the inner tube 69, the electric motor 62, and the reduction gears 63.

The electric motor 62 includes a rotor 62*b* that surrounds the inner tube 69 and a stator 62*a* that surrounds the rotor 62*b*. The stator 62*a* is connected to a battery via a wiring 45. The stator 62*a* is surrounded by the housing 67. The stator 62*a* is held by the housing 67. The rotor 62*b* is held by the inner tube 69. The rotor 62*b* rotates together with the inner tube 69 around a centerline of the steering rod 42.

The reduction gears 63 are an example of at least one reduction gear that convert the rotation of the electric motor 62 into the linear motion of the steering tube 44 in the right-left direction. The reduction gears 63 may be a ball screw mechanism, for example. The reduction gears 63 include a ball screw 64 that extends in the right-left direction along the tilt axis At, a ball nut 66 that surrounds the ball screw 64, and a plurality of balls 65 that are disposed between the ball screw 64 and the ball nut 66. The ball screw 64 is provided in the steering rod 42, and the ball nut 66 is provided in the inner tube 69. The ball screw 64 may be integral and unitary with the steering rod 42, or may be a member that is separate from the steering rod 42 and fixed to the steering rod 42. Similarly, the ball nut 66 may be integral and unitary with the inner tube 69, or may be a member that is separate from the inner tube 69 and fixed to the inner tube 69.

The housing 67 surrounds the inner tube 69. The housing 67 is longer than the inner tube 69 in the right-left direction. The housing 67 holds the ball nut 66 via a plurality of bearings B1. An outer diameter of the tubular housing 67 is smaller than an inner diameter of the tubular portion 33 of the swivel bracket 22. The housing 67 is movable to a plurality positions including a position above the housing 31 and a position in a space surrounded by the tubular portion 33 of the swivel bracket 22.

When the electric power of the battery is supplied to coils of the stator 62*a*, the rotor 62*b* and the ball nut 66 move in an axial direction of the ball screw 64 with respect to the ball screw 64 while rotating with respect to the ball screw 64. Along with this, the housing 67 moves in the axial direction of the ball screw 64 with respect to the ball screw 64. The linear motion of the housing 67 in the right-left direction is converted into rotation of the steering shaft 23 by the motion converter 46. Thus, the outboard motor main body 2 rotates around the steering axis As.

The motion converter 46 includes a drive member 47 that moves in an axial direction of the steering actuator 41 corresponding to the right-left direction, a driven member 50 that rotates around the steering axis As, and a columnar pin 48 and a slide groove 49 that convert linear motion of the drive member 47 into rotation of the driven member 50. FIG. 5 shows an example in which the columnar pin 48 is fixed to the drive member 47, and the slide groove 49 in which the columnar pin 48 is fitted is provided on the driven member 50. The driven member 50 is an example of a steering arm that rotates together with the steering shaft 23 around the steering axis As.

As shown in FIG. 3, the drive member 47 is disposed at the rear of the steering tube 44. The drive member 47 extends rearward from the steering tube 44. A front end portion of the drive member 47 is fixed to a housing 67 of the steering tube 44. The drive member 47 moves together with the housing 67 in the axial direction of the ball screw 64. A rear end portion of the drive member 47, corresponding to a tip end portion, is disposed above a front end portion of the driven member 50. The columnar pin 48 extends downward from the rear end portion of the drive member 47. The drive member 47 is shorter in the up-down direction than the steering tube 44, and shorter in the right-left direction than the steering tube 44.

The driven member 50 extends forward from the steering shaft 23. The driven member 50 is fixed to the steering shaft 23. A front end portion of the driven member 50, corresponding to a tip end portion, is disposed at a position more forward than the steering shaft 23 and more rearward than the steering tube 44. The front end portion of the driven member 50 is positioned above the bottom wall 31*b* of the swivel bracket 22. The slide groove 49 is provided at the front end portion of the driven member 50. The slide groove 49 may have a U-shape extending in a radial direction (direction perpendicular to the steering axis As) in a plan view or an O-shape elongated in the radial direction in a plan view.

As shown in FIG. 5, the drive member 47 is supported by a guide shaft 51 extending in the right-left direction. The guide shaft 51 is inserted in a guide hole h2 penetrating through the drive member 47. The guide shaft 51 is a parallel guide that is parallel to the steering rod 42. The drive member 47 is guided by the guide shaft 51 in the axial direction of the guide shaft 51. The guide shaft 51 is supported on side walls 31*s* of the swivel bracket 22 via two guide dampers 52. The two guide dampers 52 are respectively attached to both end portions of the guide shaft 51. The guide dampers 52 are preferably made of an elastic material such as rubber or resin. The guide damper 52 includes a cylindrical portion surrounding an outer circumferential surface of the guide shaft 51 and a bottom portion facing an end surface of the guide shaft 51.

The first end portion (the right end portion in FIG. 5) of the guide shaft 51 is inserted in a blind hole h3 opening at an inner side surface of the side wall 31*s*. The first end portion of the guide shaft 51 is supported by a bottom surface of the blind hole h3 via the guide damper 52. The second end portion (left end portion in FIG. 5) of the guide shaft 51 is inserted in a through hole h4 penetrating through the side wall 31*s*. A plug P1 is screwed in the through hole h4. The second end portion of the guide shaft 51 is supported by the plug P1 via the guide damper 52. Accordingly, the guide shaft 51 is held by the swivel bracket 22.

As shown in FIG. 3 and FIG. 4, the centerline of the steering tube 44 and the steering rod 42 of the steering actuator 41 is positioned on the tilt axis At. The inner circumferential surface of the tubular portion 33 surrounds the steering tube 44 in a side view. The inner diameter of the tubular portion 33 is larger than the outer diameter of the steering tube 44. The difference between the inner diameter of the tubular portion 33 and the outer diameter of the steering tube 44 is smaller than the outer diameter of the steering shaft 23. The swivel support 29 of the clamp bracket 21 includes an inner circumferential surface 29*a* surrounding the tubular portion 33. The inner circumferential surface 29*a* opens at both of the inner side surface 21*i* and the outer surface 210 of the clamp bracket 21. The steering actuator 41, the tubular portion 33, and the inner circumferential surface 29*a* are preferably coaxial with each other.

As shown in FIG. 4, the tubular portion 33 of the swivel bracket 22 is supported by the swivel support 29 of the clamp bracket 21 via two bushings 53. The bushings 53 are preferably made of a material such as a resin or a metal that is softer than the clamp brackets 21 and the swivel bracket 22. The bushing 53 includes a cylindrical portion 53*a* disposed between the inner circumferential surface 29*a* and the tubular portion 33, and an annular flange 53*b* extending outward from an end portion of the cylindrical portion 53*a*. The flange 53*b* of one bushing 53 is disposed between the inner side surface 21*i* of the clamp bracket 21 and the outer surface 22*o* of the swivel bracket 22. The flange 53*b* of the other bushing 53 is disposed between the outer surface 210 of the clamp bracket 21 and the inner side surface of the end cap 25.

As shown in FIG. 3, the tubular portion 33 of the swivel bracket 22 includes a toric portion 33*a* surrounding the steering tube 33 of the steering actuator 41 in a side view, and a plurality of projections 33*b* projecting inward from the inner circumferential surface of the toric portion 33*a*. The shafts of the plurality of bolts b3 (refer to FIG. 4) that fix the end cap 25 to the swivel bracket 22 are attached to a plurality of female screw holes h5 provided in the tubular portion 33. The plurality of female screw holes h5 open at an end surface of the tubular portion 33. The plurality of female screw holes h5 are arranged in the circumferential direction. The plurality of projections 33*b* are disposed at positions corresponding to the plurality of female screw holes h5. As shown in FIG. 4, the projections 33*b* are shorter in the right-left direction than the toric portion 33*a*.

As shown in FIG. 4, the end cap 25 preferably has a discoid shape coaxial with the tubular portion 33. The outer diameter of the end cap 25 is larger than the diameter of the inner circumferential surface 29*a* of the clamp bracket 21. The opening of the tubular portion 33 is covered by the end cap 25 from a lateral side. An outer circumferential portion of the end cap 25 is disposed more outward than the outer circumferential surface of the tubular portion 33. The shafts of the bolts b3 are inserted from the outside in the through holes h6 penetrating through the end cap 25 in the right-left direction, and project inward from the end cap 25. Tip end portions of the shafts of the bolts b3 are screwed into female screw holes h5 provided in the tubular portion 33. The heads of the bolts b3 are disposed outside the end cap 25.

An end portion of the steering rod 42 of the steering actuator 41 is supported by the end cap 25 via two shaft dampers 54. The end portion of the steering rod 42 is inserted in a through hole h7 penetrating through a central portion of the end cap 25 in the thickness direction. The steering rod 42 includes a large diameter portion 42*a*, a small diameter portion 42*b*, and a male screw portion 42*c*. The small diameter portion 42*b* of the steering rod 42 penetrates through the end cap 25 in the right-left direction. The male screw portion 42*c* of the steering rod 42 is disposed outside the end cap 25. A fixing nut N1, for example, is screwed onto the male screw portion 42*c* of the steering rod 42.

The shaft damper 54 is preferably made of an elastic material such as rubber or resin. The shaft damper 54 includes a cylindrical portion 54*a* disposed between the outer circumferential surface of the steering rod 42 and the inner circumferential surface of the end cap 25, and an annular flange 54*b* extending outward from an end portion of the cylindrical portion 54*a*. End surfaces of the cylindrical portions 54*a* of the two shaft dampers 54 face each other inside the through hole h7 of the end cap 25. The end cap 25 is disposed between the two flanges 54*b*. The two shaft dampers 54 are sandwiched by two washers W1 in the axial direction.

When an operator of the vessel operates a steering handle so as to steer the outboard motor main body 2, the electric motor 62 rotates by the rotation angle corresponding to the operation amount of the steering handle. Thus, the steering tube 44 moves in the axial direction of the steering actuator 41 with respect to the steering rod 42. The moving distance and the movement direction of the steering tube 44 are controlled by the rotation angle and the rotation direction of the electric motor 62. FIG. 6 shows a state in which a portion of the steering tube 44 is located inside a space surrounded by both of the tubular portion 33 of the swivel bracket 22 and the inner circumferential surface 29*a* of the clamp bracket 21.

The drive member 47 moves in the axial direction of the steering actuator 41 together with the steering tube 44. Along with this, an inner side surface of the driven member 50 defining the slide groove 49 is pushed in the right-left direction by the columnar pin 48. At this time, the driven member 50 pivots around the steering axis As while the columnar pin 48 moves in a radial direction inside the slide groove 49 with respect to the driven member 50. Accordingly, the steering shaft 23 rotates around the steering axis As, and along with this, the outboard motor main body 2 rotates around the steering axis As.

As described above, in the present preferred embodiment, the outboard motor main body 2 that rotates the propeller 16 rotates around the steering axis As together with the steering shaft 23 in accordance with movement of the steering tube 44 as an example of a movable body. The steering tube 44 is surrounded by the inner circumferential surface 29*a* of the clamp bracket 21 in a side view. Therefore, a space in which the steering tube 44 is disposed does not need to be provided between the clamp bracket 21 and the cowl 17. Further, since the steering tube 44 is movable to the inside of the inner circumferential surface 29*a* of the clamp brackets 21, the clamp brackets 21 do not need to be disposed laterally of the moving range of the steering tube 44. Therefore, the pair of clamp brackets 21 are prevented from increasing in size in the right-left direction.

When the outboard motor main body 2 rotates in the right-left direction around the steering axis As, the outboard motor main body 2 approaches the right or left clamp bracket 21 (refer to the outboard motor main body 2 shown by the alternate long and short dashed line in FIG. 2). If the width between the pair of clamp brackets 21 in the right-left direction is large, the outboard motor main body 2 may come into contact with the clamp bracket 21. Therefore, in order to prevent this, the clamp brackets 21 need to be shortened in the front-rear direction or reduced in size in the right-left direction. In the present preferred embodiment, since the width between the pair of clamp brackets 21 is reduced, such measures do not need to be taken.

In the present preferred embodiment, the steering tube 44 overlaps the tilt axis At in a side view. When the outboard motor main body 2 rotates around the tilt axis At, the steering tube 44 also rotates around the tilt axis At. When the steering tube 44 overlaps the tilt axis At in a side view, the range through which the steering tube 44 passes is smaller as compared with the case in which the steering tube 44 does not overlap the tilt axis. Therefore, a space inside the hull H1 in which a portion of the outboard motor main body 2 is disposed when the outboard motor main body 2 is tilted up is reduced. Accordingly, the space inside the hull H1 is effectively utilized.

In the present preferred embodiment, the steering rod 42 as an example of a support shaft penetrates through the clamp brackets 21. The steering tube 44 moves in the axial direction of the steering rod 42 along the steering rod 42. If the steering rod 42 is long, the range in which the steering tube 44 is movable is enlarged. If the range in which the steering tube 44 is movable is large, the steering angle of the outboard motor main body 2 (rotation angle around the steering axis As) is increased. In the present preferred embodiment, the steering rod 42 extends to penetrate through the clamp brackets 21. Therefore, the range in which the steering tube 44 is movable is enlarged, and the steering angle of the outboard motor main body 2 is increased.

In the present preferred embodiment, an impact applied to the steering rod 42 is absorbed by the shaft dampers 54. Therefore, the strength required for the steering rod 42 is reduced, so that the steering rod 42 is able to be reduced in size. Further, since an impact applied to the steering tube 44 is also absorbed via the steering rod 42, the steering tube 44 is able to be reduced in size. Thus, the steering tube 44 and the steering rod 42 are downsized, so that the width between the pair of clamp brackets 21 is further reduced.

In the present preferred embodiment, the tubular portion 33 corresponding to a tilting shaft is provided on the swivel bracket 22. The swivel bracket 22 is rotatable around the tubular portion 33 with respect to the clamp bracket 21. The steering tube 44 is movable to the inside of the tubular portion 33. In other words, a tilting shaft to be inserted in the clamp bracket 21 defines, inside the clamp bracket 21, a space in which the steering tube 44 is disposed. Accordingly, while a moving range of the steering tube 44 is maintained, the width between the pair of clamp brackets 21 is reduced.

In the present preferred embodiment, when the steering tube 44 and the drive member 47 move in the movement direction of the steering tube 44, the driven member 50 pivots around the steering axis As. When a pivoting angle of the driven member 50 (rotation angle around the steering axis As) is the same, the longer the distance D1 (refer to FIG. 5) from the steering axis As to the tip end of the driven member 50, the larger the pivoting range of the driven member 50 (the range through which the driven member 50 passes). If the pivoting range of the driven member 50 is large, the width between the pair of clamp brackets 21 may need to be increased.

For example, if the steering tube 44 is located closer to the driven member 50, the distance to the tip end of the driven member 50 is shortened. However, if the steering tube 44 is located closer to the driven member 50, the cowl 17 may need to be downsized, or the outboard motor main body 2 may need to be moved upward.

In the present preferred embodiment, a portion of the drive member 47 is positioned between the steering tube 44 and the driven member 50. Therefore, without locating the steering tube 44 closer to the driven member 50, movement of the steering tube 44 is transmitted to the driven member 50. Accordingly, without changing the size of the cowl 17 and the position of the outboard motor main body 2, the pivoting range of the driven member 50 is narrowed. Therefore, the width between the pair of clamp brackets 21 is narrowed.

In the present preferred embodiment, the drive member 47 is shorter in the up-down direction and the right-left direction than the steering tube 44. A portion of the drive member 47 is positioned between the steering tube 44 and the driven member 50. If the drive member 47 is long in the up-down direction, the size of the cowl 17 or the position of the outboard motor main body 2 may need to be changed. However, since the drive member 47 is shorter in the up-down direction than the steering tube 44, so that without changing the size of the cowl 17 and the position of the outboard motor main body 2, a portion of the drive member 47 is disposed between the steering tube 44 and the driven member 50. Further, the drive member 47 is shorter in the right-left direction than the steering tube 44, although the moving distance of the drive member 47 in the movement direction is the same as that of the steering tube 44, the movement range of the drive member 47 (range through which the drive member 47 passes) is smaller than that of the steering tube 44. Therefore, the width between the pair of clamp brackets 21 is further narrowed.

In the present preferred embodiment, the drive member 47 is supported by the guide shaft 51, so that the drive member 47 is moved in a stable manner in the movement direction. Further, the drive member 47 is supported by both of the steering tube 44 and the guide shaft 51, so that warping of the drive member 47 is significantly reduced or prevented.

In the present preferred embodiment, an impact applied to the guide shaft 51 is absorbed by the guide dampers 52. Therefore, the strength required for the guide shaft 51 is reduced, so that the guide shaft 51 is able to be reduced in size. Thus, since the guide shaft 51 is downsized, the width between the pair of clamp brackets 21 is further reduced.

Second Preferred Embodiment

Figure 7:
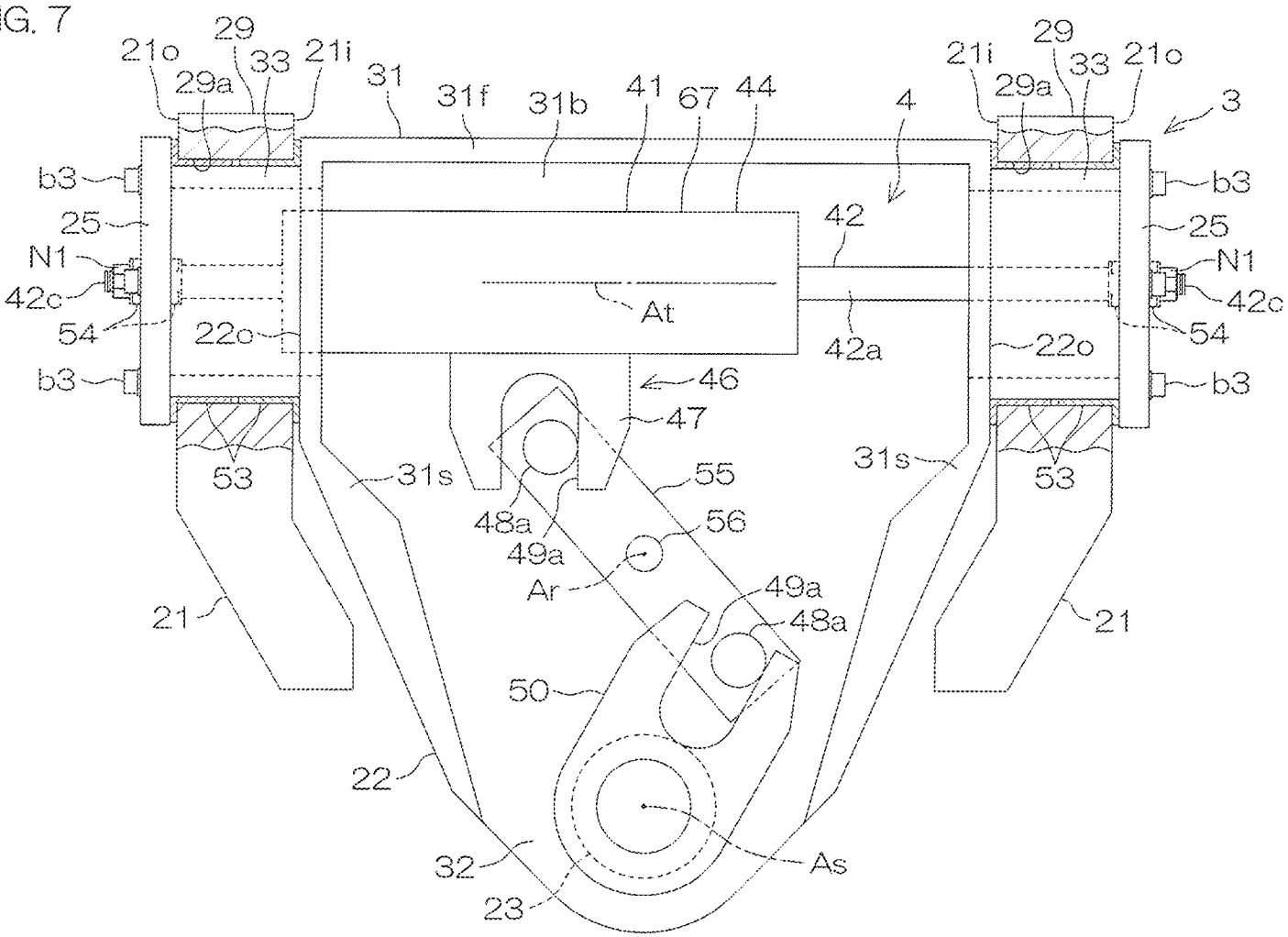
FIG. 7 is a partial sectional view of a suspension device according to a second preferred embodiment of the present invention, viewed from above.

As shown in FIG. 7, the motion converter 46 may further include a rotation arm 55 rotatable around a rotation axis Ar parallel to or substantially parallel to the steering axis As.

The rotation arm 55 is supported by the swivel bracket 22 via a central shaft 56 extending in the up-down direction. The rotation arm 55 is rotatable around the rotation axis Ar corresponding to a centerline of the central shaft 56. The rotation arm 55 is disposed above the bottom wall 31*b* of the swivel bracket 22. The rotation arm 5 is disposed lower than the drive member 47 and the driven member 50. The drive member 47 is joined to the rotation arm 55 by a columnar pin 48*a* extending upward from the rotation arm 55 and a slide groove 49*a* provided on the drive member 47. The driven member 50 is joined to the rotation arm 55 by a columnar pin 48*b* extending upward from the rotation arm 55 and a slide groove 49*b* provided on the driven member 50.

When the steering tube 44 of the steering actuator 41 moves in the axial direction of the steering actuator 41 with respect to the swivel bracket 22, a linear motion of the drive member 47 is converted into rotation of the rotation arm 55 around the rotation axis Ar by the columnar pin 48*a* and the slide groove 49*a*. Then, the rotation of the rotation arm 55 is converted into rotation of the driven member 50 around the steering axis As by the columnar pin 48*b* and the slide groove 49*b*. Accordingly, the steering shaft 23 rotates around the steering axis As, and along with this, the outboard motor main body 2 rotates around the steering axis As.

Thus, in the structure shown in FIG. 7, motion of the drive member 47 is converted into rotation of the rotation arm 55, and the rotation of the rotation arm 55 is converted into rotation of the driven member 50. Accordingly, the steering shaft 23 rotates around the steering axis As. By providing the rotation arm 55, the tip end of the drive member 47 is spaced apart from the driven member 50 as compared with the case in which the rotation arm 55 is not provided. Accordingly, the projection amount of the drive member 47 from the steering tube 44 is reduced, and the bending moment to be applied to the drive member 47 is reduced. Further, the drive member 47 is shortened, so that the guide shaft 51 (refer to FIG. 5) that supports the drive member 47 may be omitted.

Third Preferred Embodiment

Figure 8:
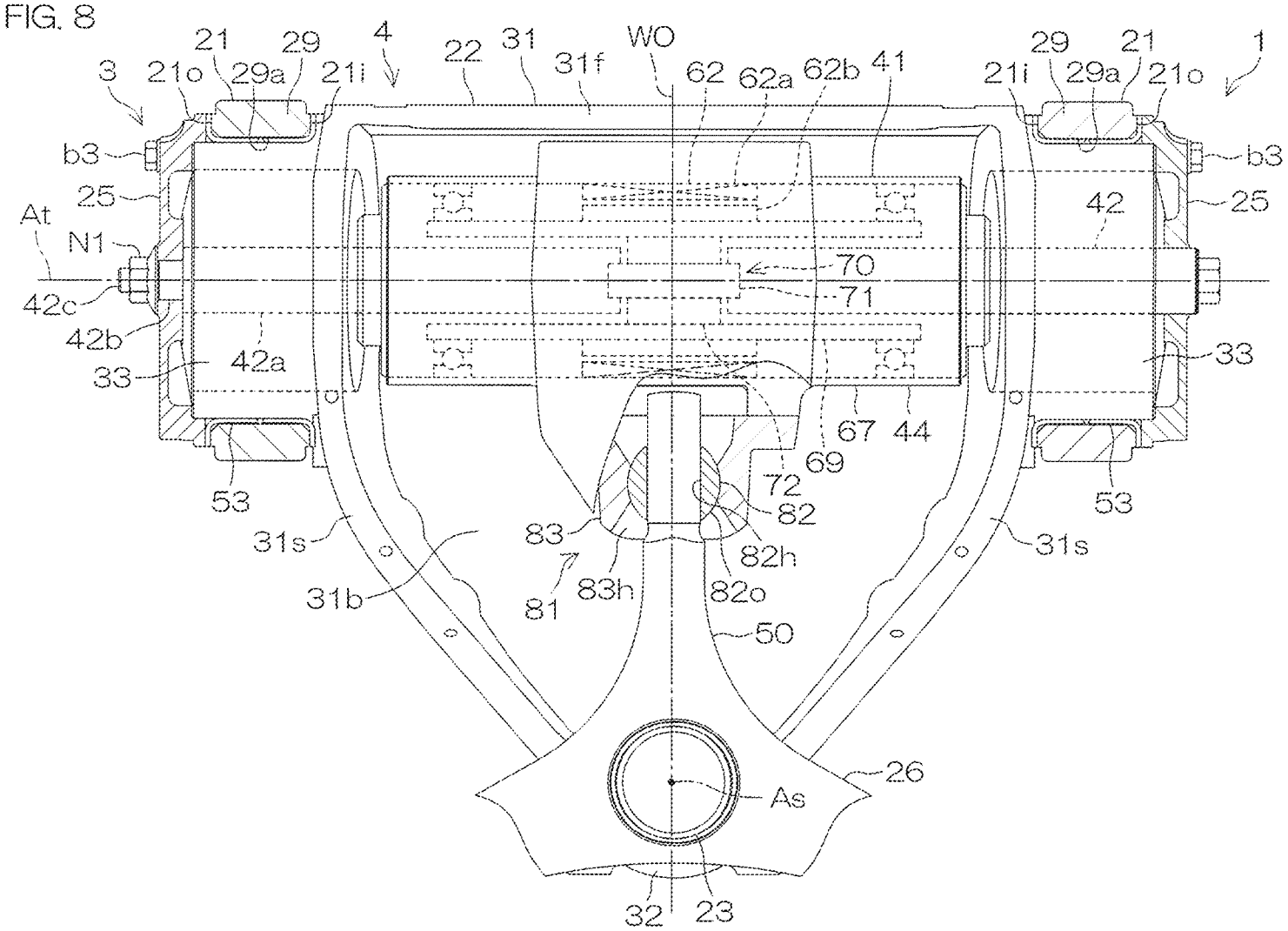
FIG. 8 is a partial sectional view of a suspension device and a steering device according to a third preferred embodiment of the present invention, viewed from above, and shows a position of the steering tube when an outboard motor main body is positioned at an original position and a top cover has been removed from the suspension device.
Figure 9:
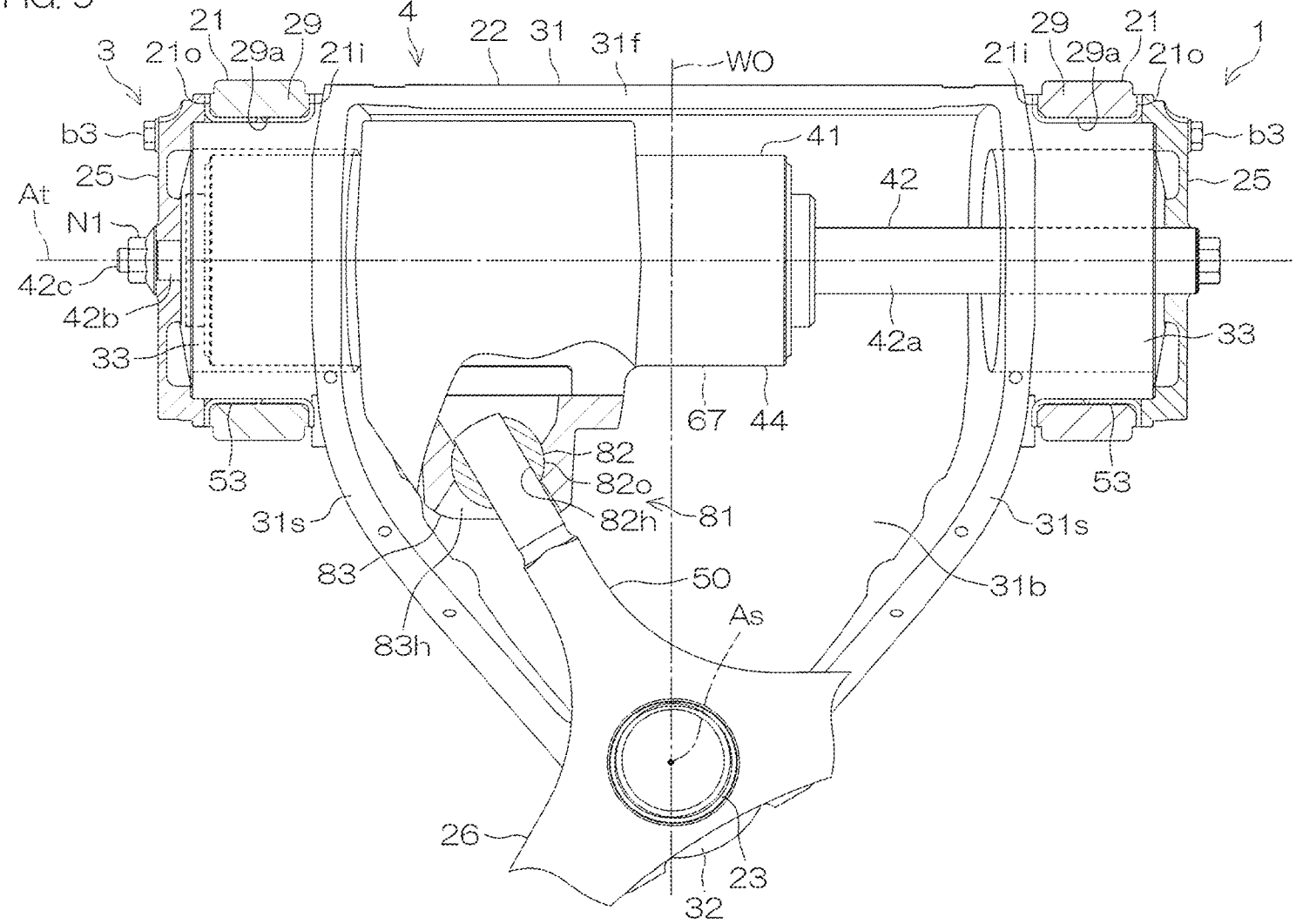
FIG. 9 is a partial sectional view of the suspension device and the steering device according to the third preferred embodiment of the present invention, viewed from above, and shows a position of the steering tube when an outboard motor main body is positioned at a right maximum steered position and a top cover has been removed from the suspension device.

FIG. 8 and FIG. 9 are partial sectional views of the suspension device 3, from which the top cover 24 (refer to FIG. 1) is removed, and the steering device 4, viewed from above.

FIG. 8 shows a position of the steering tube 44 when the outboard motor main body 2 (refer to FIG. 1) is disposed at the original position. FIG. 9 shows a position of the steering tube 44 when the outboard motor main body 2 is disposed at the right maximum steered position. A reference plane WO shown in FIG. 8 and FIG. 9 denotes the vertical plane that passes through the steering axis As and perpendicular or substantially perpendicular to the right-left direction. In FIG. 8 and FIG. 9, components equivalent to the above described components shown in FIG. 1 to FIG. 7 are designated by the same reference characters as in FIG. 1, etc., and description thereof is omitted.

As shown in FIG. 8, the steering actuator 41 includes reduction gears 70, instead of the reduction gears 63 according to the first preferred embodiment. The reduction gears 70 may be a roller screw assembly, for example. The roller screw assembly includes a center shaft 71 extending in the right-left direction and a plurality of cylindrical rollers 72 disposed around the center shaft 71. The inner tube 69 surrounds the plurality of cylindrical rollers 72.

A centerline of the center shaft 71 is disposed on the tilt axis At. The center shaft 71 may be integral and unitary with the steering rod 42, or may be a member that is separate from the steering rod 42 and fixed to the steering rod 42. Each of the spiral screw threads provided on the outer circumferential surfaces of the cylindrical rollers 72 is engaged with a spiral screw thread provided on the outer circumferential surface of the center shaft 71 and a spiral screw thread provided on the inner circumferential surface of the inner tube 69.

The rotation of the center shaft 71 is converted into the linear motion of the inner tube 69 by the center shaft 71, the cylindrical roller 72, and the inner tube 69. Similarly, the rotation of the inner tube 69 is converted into the linear motion of the center shaft 71 by the center shaft 71, the cylindrical roller 72, and the inner tube 69. When one of the center shaft 71 and the inner tube 69 is rotated, the other of the center shaft 71 and the inner tube 69 moves linearly, and thus the center shaft 71 and the inner tube 69 move relatively in the axial direction of the center shaft 71 (the right-left direction).

When the electric motor 62 rotates the inner tube 69, the torque transmitted from the electric motor 62 to the inner tube 69 is converted into a driving force to move the inner tube 69 linearly in the right-left direction by the center shaft 71, the cylindrical roller 72, and the inner tube 69. This driving force moves the steering tube 44 in a right direction or a left direction with respect to the steering rod 42. The moving distance and the movement direction of the steering tube 44 are controlled by the rotation angle and the rotation direction of the electric motor 62.

As shown in FIG. 8, the steering device 4 includes a motion converter 81 that converts the linear motion of the steering actuator 41 into the rotation of the steering shaft 23, instead of the motion converter 46 according to the first preferred embodiment.

The motion converter 81 includes a spherical bushing 82 attached to the front end portion of the driven member 50 and a bushing holder 83 that holds the bushing 82. The bushing holder 83 moves in the right-left direction with respect to the steering rod 42 together with the steering tube 44. The front end portion of the driven member 50 is inserted into an arm-insertion hole **83*h* extending forward from the rear surface of the bushing holder 83. Further, the front end portion of the driven member 50 is inserted into an insertion hole 82*h* extending forward from the spherical outer surface 82*o* of the bushing 82. The driven member 50** is an example of the steering arm.

As shown in FIG. 9, when, the steering actuator 41 generates a right steering force that moves the steering tube 44 in the left direction, this right steering force is transmitted to the driven member 50 via the housing 67, the bushing holder 83, and the bushing 82. Thus, the driven member 50 is pushed leftward, and the driven member 50 and the steering shaft 23 turn leftward around the steering axis As. The outboard motor main body 2 turns rightward around the steering axis As accordingly.

Similarly, when, the steering actuator 41 generates a left steering force that moves the steering tube 44 in the right direction, this left steering force is transmitted to the driven member 50 via the housing 67, the bushing holder 83, and the bushing 82. Thus, the driven member 50 is pushed rightward, and the driven member 50 and the steering shaft 23 turn rightward around the steering axis As. The outboard motor main body 2 turns leftward around the steering axis As accordingly.

FIG. 9 shows the position of the steering tube 44 when the outboard motor main body 2 is disposed at the right maximum steered position. When the outboard motor main body 2 is disposed at the right maximum steered position, the left end portion of the steering tube 44 is disposed inside a space surrounded by both of the swivel support 2 of the left clamp bracket 21 and the left tubular portion 33 of the swivel bracket 22. The left maximum steered position is a position symmetrical or substantially symmetrical to the right maximum steered position with respect to the reference plane WO. When the outboard motor main body 2 is disposed at the left maximum steered position, the right end portion of the steering tube 44 is disposed inside a space surrounded by both of the swivel support 2 of the right clamp bracket 21 and the right tubular portion 33 of the swivel bracket 22.

Fourth Preferred Embodiment

Figure 10:
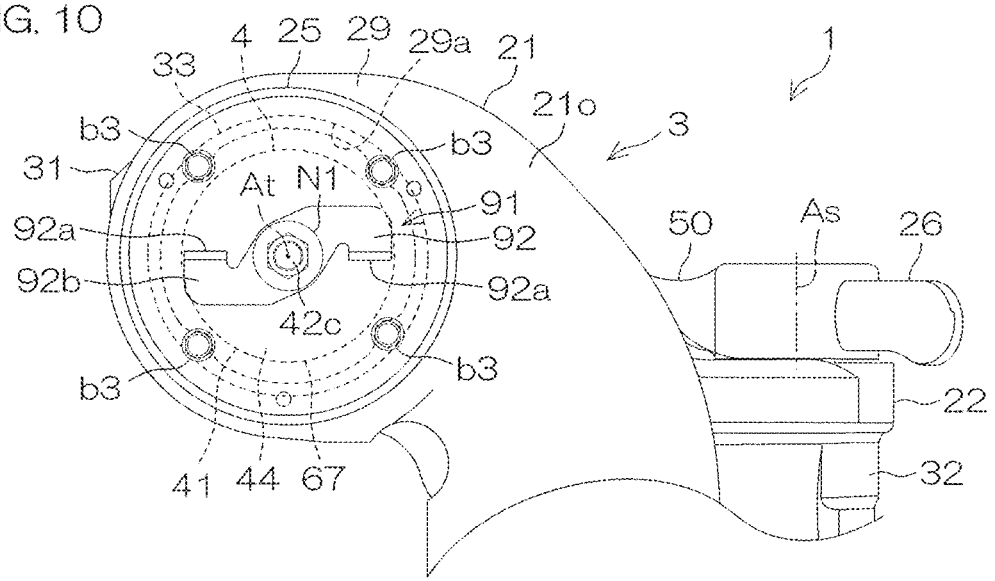
FIG. 10 is a left side view of an upper portion of a suspension device, from which a side cover is removed, according to a fourth preferred embodiment of the present invention.
Figure 11:
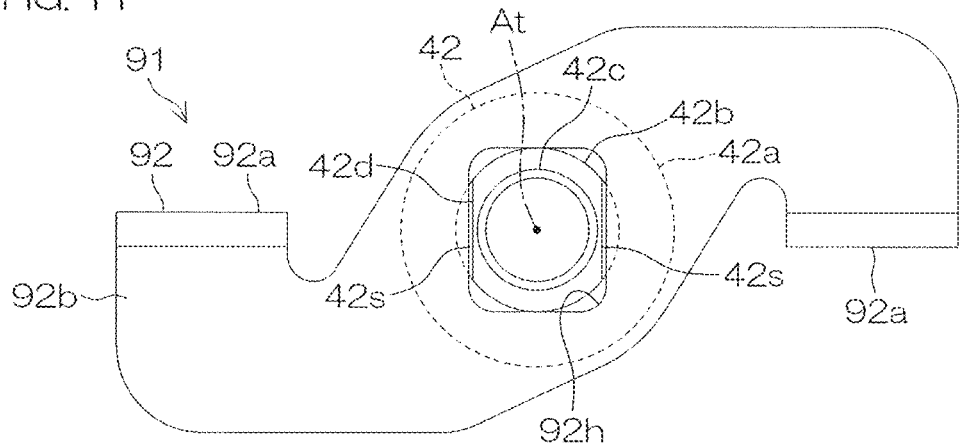
FIG. 11 is a left side view of a handle into which a steering rod is inserted.
Figure 12:
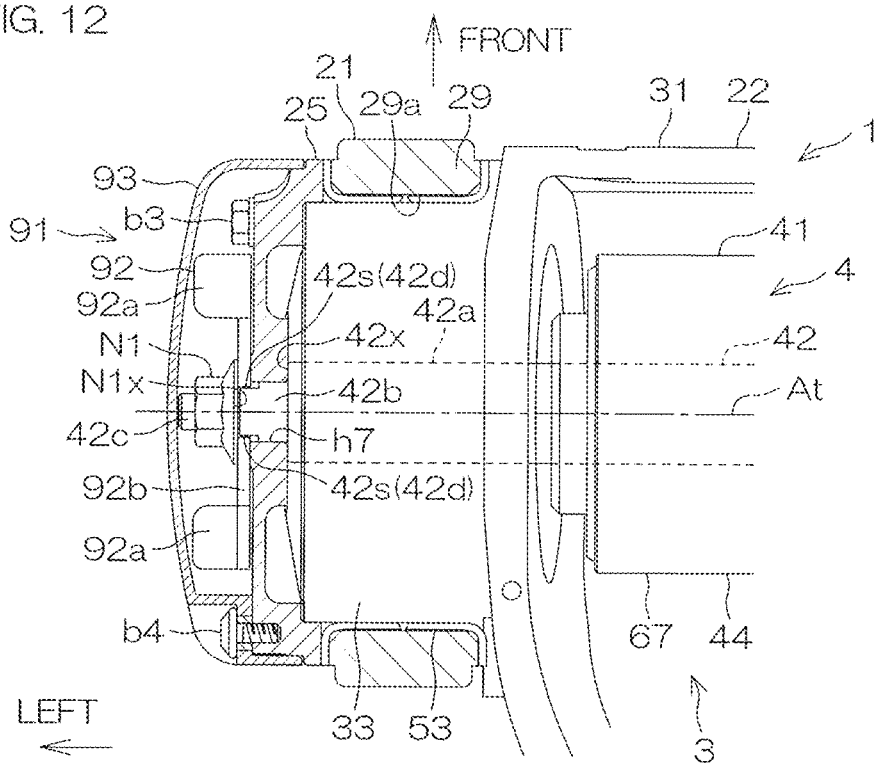
FIG. 12 is a partial sectional view of a left end portion of the suspension device, viewed from above.
Figure 13:
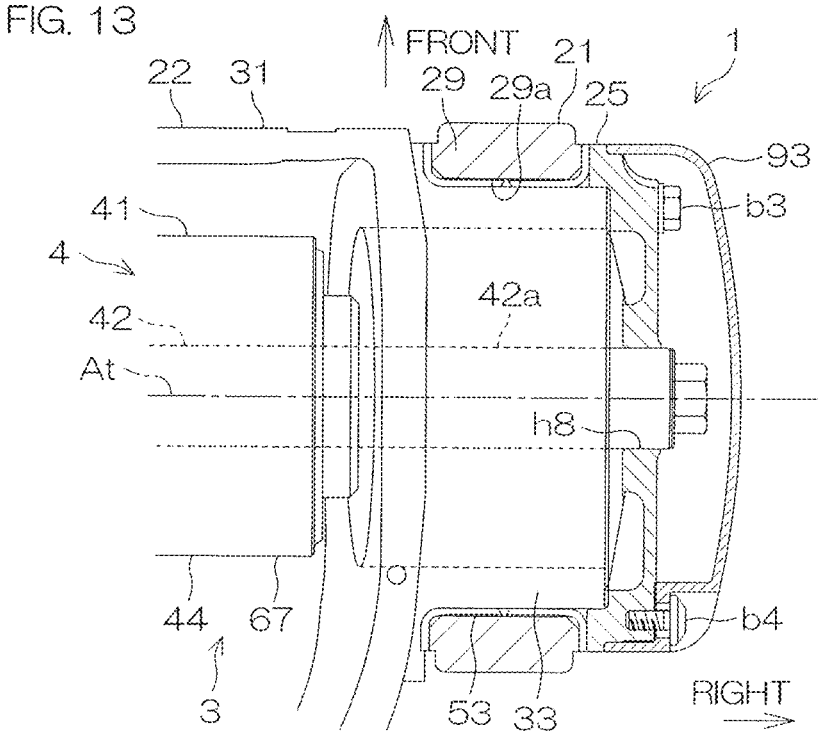
FIG. 13 is a partial sectional view of a right end portion of the suspension device, viewed from above.
Figure 14:
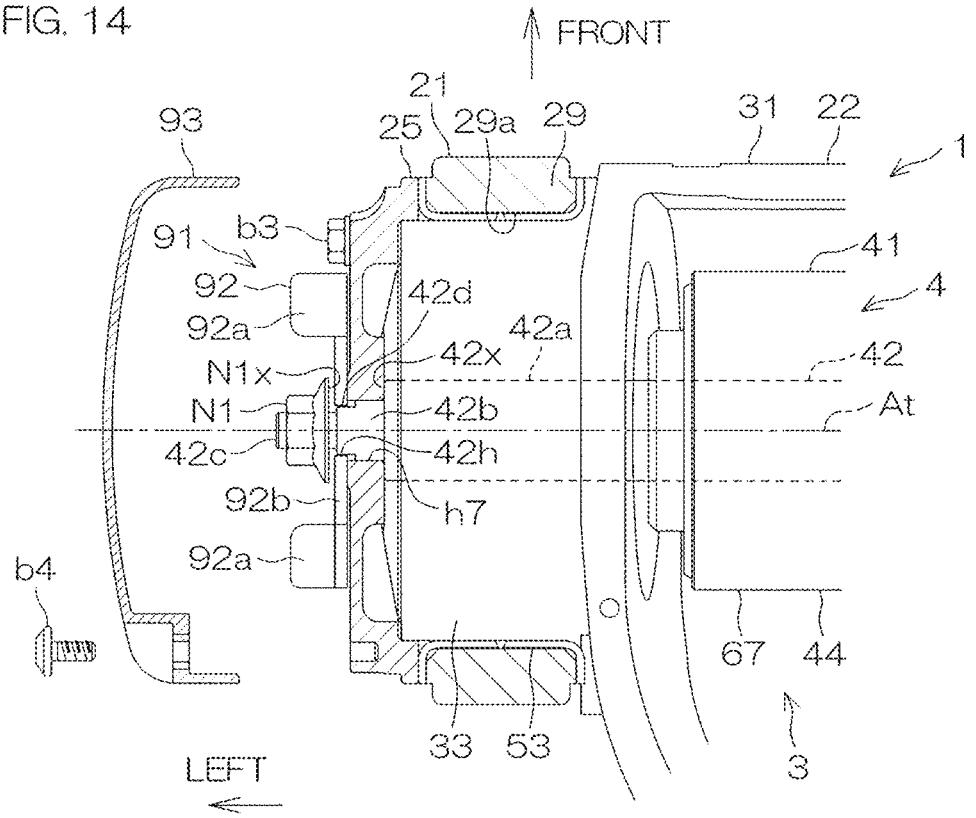
FIG. 14 is a partial sectional view for describing procedures to manually steer the outboard motor main body.

FIG. 10 is a left side view of the upper portion of the suspension device 3 from which a side cover 93 (refer to FIG. 12) is removed. FIG. 11 is a left side view of a handle 92 into which the steering rod 42 is inserted. FIG. 12 is a partial sectional view of the left end portion of the suspension device 3, viewed from above. FIG. 13 is a partial sectional view of the right end portion of the suspension device 3, viewed from above. FIG. 14 is a partial sectional view for describing procedures to manually steer the outboard motor main body 2 (refer to FIG. 1). In FIG. 10 and FIG. 14, components equivalent to the above described components shown in FIG. 1 to FIG. 9 are designated by the same reference characters as in FIG. 1, etc., and description thereof is omitted.

As shown in FIG. 10, the outboard motor 1 may include a manual steering device 91 that turns rightward or leftward the outboard motor main body 2, in addition to the automatic steering device 4. As shown in FIG. 11, the manual steering device 91 includes the handle 92 that is to be operated by an operator when the outboard motor main body 2 is steered manually and a handle attachment 42*d* to which the handle 92 is attached. The handle attachment 42*d* is provided in the steering rod 42 and the handle 92 is attached to the steering rod 42.

As shown in FIG. 12 and FIG. 13, the suspension device 3 may further include the side cover 93 attached to the end cap 25. The side cover 93 is disposed laterally of the end cap 25 and fixed to the end cap 25 by bolts b4, for example. As shown in FIG. 12, the handle 92 is disposed between the side cover 93 on the left side and the end cap 25 on the left side, and covered by the side cover 93.

As shown in FIG. 11, the handle 92 includes at least one contact portion 92*a* that contacts with a hand of the operator and a connector 92*b* that connects the at least one contact portion 92*a* with the handle attachment 42*d*. FIG. 11 shows an example in which two contact portions 92*a* are provided on the handle 92. The handle 92 may include a folded metal plate, for example. The contact portion 92*a* is disposed around the large diameter portion 42*a* of the steering rod 42 in a side view.

The handle attachment 42*d* includes a shaft inserted into a through hole 92*h* that penetrates the connector 92*b* of the handle 92 in the right-left direction. The handle attachment 42*d* is provided on the outer circumferential surface of the small diameter portion 42*b* of the steering rod 42. FIG. 11 shows an example in which the through hole 92*h* of the handle 92 has a quadrilateral shape and the handle attachment 42*d* includes two flat surfaces 42*s* parallel to each other. Each of the handle attachment 42*d* and the through hole 92*h* may have any shape as long as the shape is able to transmit torque from the handle 92 to the steering rod 42. For example, the handle attachment 42*d* may be a spline shaft and the through hole 92*h* may be a spline hole. The handle 92 may be fixed to the handle attachment 42*d* by welding or caulking, for example.

As shown in FIG. 12, the left end portion of the steering rod 42 includes the small diameter portion 42*b* and the male screw portion 42*c*. The small diameter portion 42*b* of the steering rod 42 is inserted into the through hole h7 that penetrates the central portion of the left end cap 25 in the right-left direction. The inner diameter of the through hole h7 is smaller than the outer diameter of the large diameter portion 42*a* of the steering rod 42. The male screw portion 42*c* of the steering rod 42 is disposed laterally of the end cap 25. The fixing nut N1 is screwed onto the male screw portion 42*c*. The connector 92*b* of the handle 92 is disposed between the fixing nut N1 and the end cap 25.

The handle 92 and the end cap 25 are sandwiched by the inner side surface N1*x* of the fixing nut N1 and the end surface 42*x* of the large diameter portion 42*a* in the axial direction of the steering rod 42. Thus, the steering rod 42 and the handle 92 are fixed to the end cap 25. The end cap 25 is fixed to the swivel bracket 22 by the bolts b3, for example. Thus, the steering rod 42 and the handle 92 are fixed to the swivel bracket 22 indirectly. When the fixing nut N1 is in a state of being fastened, the steering rod 42 and the handle 92 are not able to rotate with respect to the swivel bracket 22.

In contrast, as shown in FIG. 13, the small diameter portion 42*b* and the male screw portion 42*c* are not provided in the right end portion of the steering rod 42. The right end portion of the large diameter portion 42*a* of the steering rod 42, which corresponds to the right end portion of the steering rod 42, is inserted into a through hole h8 that penetrates the central portion of the right end cap 25 in the right-left direction. The inner diameter of the through hole h8 is larger than the outer diameter of the large diameter portion 42*a* of the steering rod 42. The steering rod 42 is supported by the inner circumferential surface of the right end cap 25, and is not fixed to the right end cap 25. Thus, when the fixing nut N1 is loosened, the steering rod 42 and the handle 92 are no longer fixed with respect to the swivel bracket 22.

As shown in FIG. 14, when the outboard motor main body 2 (refer to FIG. 1) is steered manually, the bolts b4, which fix the side cover 93 to the end cap 25, are rotated and loosened. After that, the side cover 93 on the left side is detached from the end cap 25. Thus, the fixing nut N1 and the handle 92 are exposed. After that, the fixing nut N1 is rotated and loosened. Thus, the steering rod 42 and the handle 92 are no longer fixed with respect to the swivel bracket 22.

After the fixing nut N1 is loosened, the handle 92 is rotated by hand. Thus, the handle 92 and the steering rod 42 rotate around the centerline of the steering rod 42 corresponding to the tilt axis At. The rotation of the steering rod 42 is converted into the movement of the steering tube 44 in the right-left direction by the reduction gears 63 shown in FIG. 5. Thus, the outboard motor main body 2 turns rightward or leftward around the steering axis As, and is steered manually.

As described above, in the fourth preferred embodiment, the steering rod 42 is prevented from rotating with respect to the swivel bracket 22 by the fixing nut N1 attached to the steering rod 42. When the electric motor 62 rotates the inner tube 69 (refer to 5), the rotation of the inner tube 69 is converted into the relative motion of the inner tube 69 and the steering rod 42 in the axial direction of the steering rod 42 by the reduction gears 63. Thus, the steering tube 44, which is an example of the movable body, moves in the right-left direction and the outboard motor main body 2 is steered automatically.

When the fixing nut N1 is loosened, the steering rod 42 is able to be rotated with respect to the swivel bracket 22. In this state, when the operator operates the handle 92 attached to the handle attachment 42*d* of the steering rod 42 so as to rotate the steering rod 42, the rotation of the steering rod 42 is converted into the relative motion of the inner tube 69 and the steering rod 42 in the axial direction of the steering rod 42 by the reduction gears 63. Thus, the steering tube 44 moves in the right-left direction and the outboard motor main body 2 is steered manually.

It is conceivable that the operator directly pushes the outboard motor main body 2 so as to manually steer the outboard motor main body 2. In this case, if the reduction ratio of the reduction gears 63 is large, even when a circuit to drive the electric motor 62 is opened, the outboard motor main body 2 is not steered manually unless a large force is applied to the outboard motor main body 2. In contrast, in a case of rotating the steering rod 42 by operating the handle 92, the outboard motor main body 2 is steered manually with a small force as compared with a case in which the outboard motor main body 2 is pushed directly.

In the fourth preferred embodiment, the handle 92, which is to be operated when the outboard motor main body 2 is steered manually, is provided in the outboard motor 1 and attached to the handle attachment 42*d*. Thus, the user of the outboard motor 1 does not need to prepare a tool, etc., and to attach the tool, etc., to the handle attachment 42*d*. The time required to prepare the manual steering of the outboard motor main body 2 is shortened accordingly.

In the fourth preferred embodiment, the steering rod 42 is prevented from rotating with respect to the swivel bracket 22 only by the single fixing nut N1. In a case in which a plurality of fixing nuts N1 are attached to the steering rod 42, the prevention of the rotation of the steering rod 42 with respect to the swivel bracket 22 is not released unless all of the fixing nuts N1 are loosened. In contrast, in a case in which the steering rod 42 is prevented from rotating with respect to the swivel bracket 22 only by the single fixing nut N1, the prevention of the rotation of the steering rod 42 with respect to the swivel bracket 22 is released only by loosening the single fixing nut N1. Thus, the time required to prepare the manual steering of the outboard motor main body 2 is shortened.

Other Preferred Embodiments

The present invention is not restricted to the contents of the above-described preferred embodiments and various modifications are possible within the scope of the present invention.

In the first preferred embodiment, a case in which the steering rod 42 of the steering actuator 41 is parallel to the tilt axis At is described. However, the steering rod 42 of the steering actuator 41 may be inclined with respect to the tilt axis At.

In the first preferred embodiment, a case in which the inner circumferential surface 29*a* of the clamp bracket 21 opens at both of the inner side surface 21*i* and the outer surface 210 of the clamp bracket 21 is described. However, the inner circumferential surface 29*a* does not need to open at the outer surface 210 of the clamp bracket 21. That is, the insertion hole defined by the inner circumferential surface 29*a* may not be a through hole but be a blind hole.

The steering rod 42 of the steering actuator 41 may be directly supported by the end caps 25. That is, the shaft dampers 54 disposed between the steering rod 42 and the end caps 25 may be omitted. Similarly, the guide dampers 52 disposed between the guide shaft 51 and the swivel bracket 22 may be omitted. In addition, the guide shaft 51 that guides the drive member 47 in the axial direction of the steering actuator 41 may be omitted.

The tubular portions 33 to be inserted into the inner circumferential surface 29*a* of the clamp brackets 21 may be members separate from the housing 31 of the swivel bracket 22. In this case, as a method to fix the tubular portions 33 to the swivel bracket 22, any of press fitting, welding, and fastening with bolts may be used, or a method other than these may be used.

In the first preferred embodiment, a case in which the columnar pin 48 is fixed to the drive member 47, and the slide groove 49 is provided on the driven member 50 is described. However, it is also possible that the columnar pin 48 is provided on the driven member 50, and the slide groove 49 is provided on the drive member 47.

In the fourth preferred embodiment, as with the left end portion of the steering rod 42, the right end portion of the steering rod 42 may be fixed to the end cap 25 on the right side by the fixing nut N1.

Figure 15:
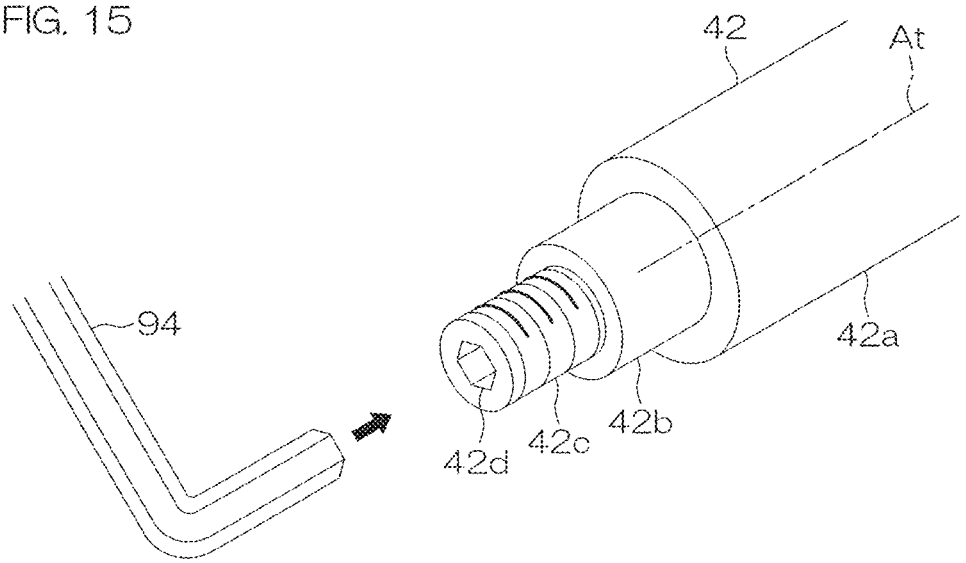
FIG. 15 is a schematic view showing a handle attachment according to another preferred embodiment of the present invention.

The handle attachment 42*d* according to the fourth preferred embodiment may include a hole that is recessed from the left end surface of the steering rod 42 and has a polygonal shape in a side view. FIG. 15 shows an example in which the hole has a hexagonal shape in a side view and is provided in the left end surface of the steering rod 42. In the case of this example, an end portion of a hexagonal wrench 94, which is an example of the handle, is inserted into the hole and the hexagonal wrench 94 is rotated.

The outboard motor 1 according to the fourth preferred embodiment may not include the handle 92. In this case, a dedicated or general-purpose tool, which is an example of the handle, may be attached to the handle attachment 42*d*, when needed. For example, after the fixing nut N1 is loosened, the handle 92 and an additional nut may be attached to the male screw portion 42*c* of the steering rod 42 so as to cause the two nuts (the fixing nut N1 and the additional nut) to sandwich the handle 92 in the axial direction of the steering rod 42 and to fix the handle 92 to the steering rod 42. That is, the male screw portion 42*c* of the steering rod 42 may double as the handle attachment 42*d*.

Figure 16:
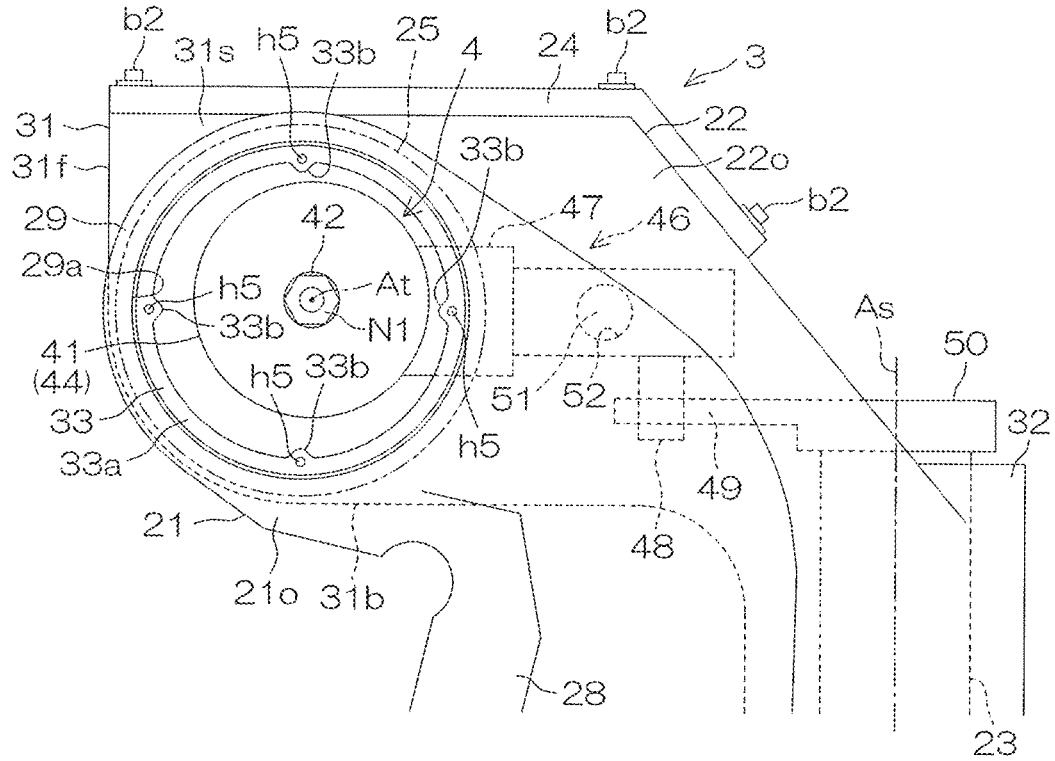
FIG. 16 is a view of an upper portion of a suspension device according to still another preferred embodiment of the present invention, viewed from a left side.

As shown in FIG. 16, the steering actuator 41 may be eccentric with respect to the tilt axis At. That is, the centerlines of the steering tube 44 and the steering rod 42 do not need to be disposed on the tilt axis At. In this case, the steering actuator 41 does not need to overlap the tilt axis At in a side view.

Features of two or more of the various preferred embodiments described above may be combined.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

a pair of clamp brackets each provided with an inner side surface, an inner circumferential surface that is open at the inner side surface, and an attaching portion attachable to a rear surface of a hull, the pair of clamp brackets being spaced apart from each other in a right-left direction;

a swivel bracket disposed between the pair of clamp brackets, and rotatable with respect to the pair of clamp brackets around a tilt axis extending in the right-left direction;

a movable body surrounded by the inner circumferential surface of the clamp bracket in a side view of the outboard motor and movable to a plurality of positions including a position above the swivel bracket and a position inside a space surrounded by the inner circumferential surface of the clamp bracket;

a steering shaft that rotates around a steering axis extending in an up-down direction in accordance with movement of the movable body; and an outboard motor main body that rotates around the steering axis together with the steering shaft and includes a prime mover that generates power to rotate a propeller.

2. The outboard motor according to claim 1, wherein the movable body overlaps the tilt axis in the side view of the outboard motor.

3. The outboard motor according to claim 2, further comprising a support shaft extending in an axial direction parallel to or substantially parallel to the tilt axis; wherein the movable body is movable in the axial direction of the support shaft along the support shaft.

4. The outboard motor according to claim 3, wherein the support shaft penetrates through the clamp bracket.

5. The outboard motor according to claim 3, further comprising a shaft damper that supports the support shaft.

6. The outboard motor according to claim 1, wherein the swivel bracket includes a tubular portion surrounding the tilt axis and is inserted in the inner circumferential surface of the clamp bracket; and the movable body is movable to a position inside a space surrounded by both of the inner circumferential surface of the clamp bracket and the tubular portion.

7. The outboard motor according to claim 1, further comprising a motion converter including a driven member that rotates around the steering axis together with the steering shaft and a drive member that is disposed closer to the driven member than the movable body and moves in a movement direction of the movable body together with the movable body, the motion converter converting movement of the movable body into rotation of the steering shaft.

8. The outboard motor according to claim 7, wherein the drive member is shorter in the up-down direction than the movable body, and is shorter in the right-left direction than the movable body.

9. The outboard motor according to claim 7, wherein the motion converter further includes a guide that guides the drive member in the movement direction of the movable body.

10. The outboard motor according to claim 9, wherein the motion converter further includes a guide damper that supports the guide.

11. The outboard motor according to claim 7, wherein the motion converter further includes a rotation arm that is rotatable around a rotation axis parallel to or substantially parallel to the steering axis and transmits motion, transmitted from the drive member, to the driven member.

12. The outboard motor according to claim 1, further comprising:

a support shaft extending in an axial direction parallel to or substantially parallel to the tilt axis; and a fixing nut that is attached to the support shaft and prevents a rotation of the support shaft with respect to the swivel bracket; wherein the movable body includes an inner tube that surrounds the support shaft, an electric motor that rotates the inner tube, and at least one reduction gear that moves the inner tube and the support shaft relatively in the axial direction of the support shaft in accordance with either a rotation of the inner tube or a rotation of the support shaft.

13. The outboard motor according to claim 12, further comprising a handle that is handled by an operator to rotate the support shaft; wherein the support shaft includes a handle attachment to which the handle is attached.

14. The outboard motor according to claim 12, wherein the fixing nut alone prevents the support shaft from rotating with respect to the swivel bracket.

15. The outboard motor according to claim 12, wherein the fixing nut prevents rotation of the support shaft with respect to the clamp bracket.

* * * * *